US007179981B2

(12) United States Patent
Gayama

(10) Patent No.: US 7,179,981 B2
(45) Date of Patent: Feb. 20, 2007

(54) MUSIC STRUCTURE DETECTION APPARATUS AND METHOD

(75) Inventor: Shinichi Gayama, Tsurugashima (JP)

(73) Assignee: Pioneer Corpoartion, Tokyo-To (JP)

( * ) Notice: Subject to any disclaimer, the term of this patent is extended or adjusted under 35 U.S.C. 154(b) by 326 days.

(21) Appl. No.: 10/724,896

(22) Filed: Dec. 2, 2003

(65) Prior Publication Data

US 2004/0255759 A1 Dec. 23, 2004

(30) Foreign Application Priority Data

Dec. 4, 2002 (JP) ..... 2002-352865

(51) Int. Cl.
*G10H 1/38* (2006.01)

(52) U.S. Cl. ..... 84/613; 84/637; 84/669

(58) Field of Classification Search ..... 84/613, 84/637, 669, 650

See application file for complete search history.

(56) References Cited

U.S. PATENT DOCUMENTS 5,440,756 A * 8/1995 Larson ..... 704/278
5,760,325 A 6/1998 Aoki ..... 84/613
5,763,802 A * 6/1998 Aoki et al. ..... 84/613
6,057,502 A * 5/2000 Fujishima ..... 84/637

* cited by examiner

*Primary Examiner*—Lincoln Donovan
*Assistant Examiner*—David S. Warren
(74) *Attorney, Agent, or Firm*—Drinker Biddle & Reath LLP

(57) ABSTRACT

An apparatus and a method for detecting the structure of a music piece which produces partial music data pieces each including a predetermined number of consecutive chords starting from a position of each chord in chord progression music data; compares the partial music data pieces with the chord progression music data to calculate degrees of similarity for each of the partial music data pieces; detects a position of a chord in the chord progression music data where the calculated similarity degree indicates a peak value higher than a predetermined value for each of the partial music data pieces; and calculates the number of times that the calculated similarity degree indicates a peak value higher than the predetermined value for all the partial music data pieces for each chord position in the chord progression music data to produce a detection output representing the structure of the music piece.

11 Claims, 19 Drawing Sheets

FIG.3

| | |
|---|---|
| A | 1.0 |
| A# | A × 1.059163 |
| B | A × 1.124622 |
| C | A × 1.189207 |
| C# | A × 1.259921 |
| D | A × 1.334840 |
| D# | A × 1.414214 |
| E | A × 1.498307 |
| F | A × 1.587401 |
| F# | A × 1.681793 |
| G | A × 1.781797 |
| G# | A × 1.887749 |
| A | A × 2.0 |

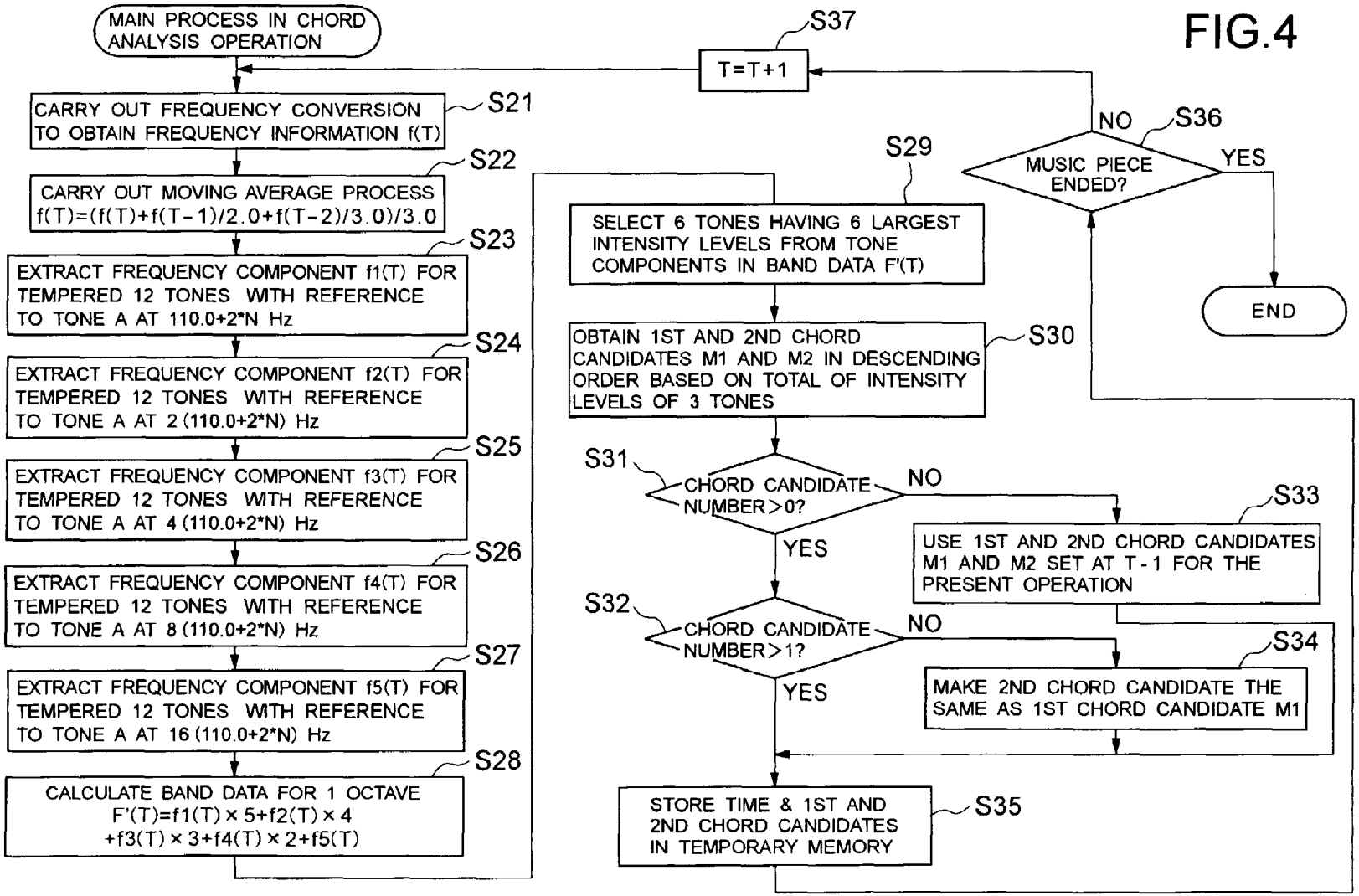
FIG.4
MAIN PROCESS IN CHORD ANALYSIS OPERATION
S21
CARRY OUT FREQUENCY CONVERSION TO OBTAIN FREQUENCY INFORMATION f(T)
S22
CARRY OUT MOVING AVERAGE PROCESS f(T)=(f(T)+f(T-1)/2.0+f(T-2)/3.0)/3.0
S23
EXTRACT FREQUENCY COMPONENT f1(T) FOR TEMPERED 12 TONES WITH REFERENCE TO TONE A AT 110.0+2*N Hz
S24
EXTRACT FREQUENCY COMPONENT f2(T) FOR TEMPERED 12 TONES WITH REFERENCE TO TONE A AT 2 (110.0+2*N) Hz
S25
EXTRACT FREQUENCY COMPONENT f3(T) FOR TEMPERED 12 TONES WITH REFERENCE TO TONE A AT 4 (110.0+2*N) Hz
S26
EXTRACT FREQUENCY COMPONENT f4(T) FOR TEMPERED 12 TONES WITH REFERENCE TO TONE A AT 8 (110.0+2*N) Hz
S27
EXTRACT FREQUENCY COMPONENT f5(T) FOR TEMPERED 12 TONES WITH REFERENCE TO TONE A AT 16 (110.0+2*N) Hz
S28
CALCULATE BAND DATA FOR 1 OCTAVE F'(T)=f1(T)×5+f2(T)×4 +f3(T)×3+f4(T)×2+f5(T)
S29
SELECT 6 TONES HAVING 6 LARGEST INTENSITY LEVELS FROM TONE COMPONENTS IN BAND DATA F'(T)
S30
OBTAIN 1ST AND 2ND CHORD CANDIDATES M1 AND M2 IN DESCENDING ORDER BASED ON TOTAL OF INTENSITY LEVELS OF 3 TONES
S31
CHORD CANDIDATE NUMBER>0?
NO
YES
S32
CHORD CANDIDATE NUMBER>1?
NO
YES
S33
USE 1ST AND 2ND CHORD CANDIDATES M1 AND M2 SET AT T-1 FOR THE PRESENT OPERATION
S34
MAKE 2ND CHORD CANDIDATE THE SAME AS 1ST CHORD CANDIDATE M1
S35
STORE TIME & 1ST AND 2ND CHORD CANDIDATES IN TEMPORARY MEMORY
S36
MUSIC PIECE ENDED?
NO
YES
END
S37
T=T+1

FIG.7

A+C+E+G(Am7)
→ A+C+E(Am) | C+E+G(C)

A+C+E♭+F#(Adim7)
→ A+C+E♭(Adim7 CANDIDATE) | C+E♭+F#(Cdim7 CANDIDATE)

A+C#+E+G(A7)
→ A+C#+E(A) | A+C#+G(A7 CANDIDATE) | C#+E+G(C#dim7 CANDIDATE)

A+C+E+G+B(Am7.9)
→ A+C+E(Am) | C+E+G(C) | E+G+B(Em)

FIG.8

TIME (4 BYTES) 1ST CHORD CANDIDATE (1 BYTE) 2ND CHORD CANDIDATE (1 BYTE)
TIME (4 BYTES) 1ST CHORD CANDIDATE (1 BYTE) 2ND CHORD CANDIDATE (1 BYTE)

⋮

TIME (4 BYTES) 1ST CHORD CANDIDATE (1 BYTE) 2ND CHORD CANDIDATE (1 BYTE)

FIG.9A

| FUNDAMENTAL TONE | |
|---|---|
| A | 0 × 00 |
| A# | 0 × 01 |
| B | 0 × 02 |
| C | 0 × 03 |
| C# | 0 × 04 |
| D | 0 × 05 |
| D# | 0 × 06 |
| E | 0 × 07 |
| F | 0 × 08 |
| F# | 0 × 09 |
| G | 0 × 0A |
| G# | 0 × 0B |

FIG.9B

| ATTRIBUTE | |
|---|---|
| MAJOR | 0 × 00 |
| MINOR | 0 × 02 |
| 7TH CANDIDATE | 0 × 01 |
| DIM 7TH CANDIDATE | 0 × 03 |

FIG.9C

ATTRIBUTE (LOWER 4 BITS) + FUNDAMENTAL TONE (LOWER 4 BITS)

FIG.14A

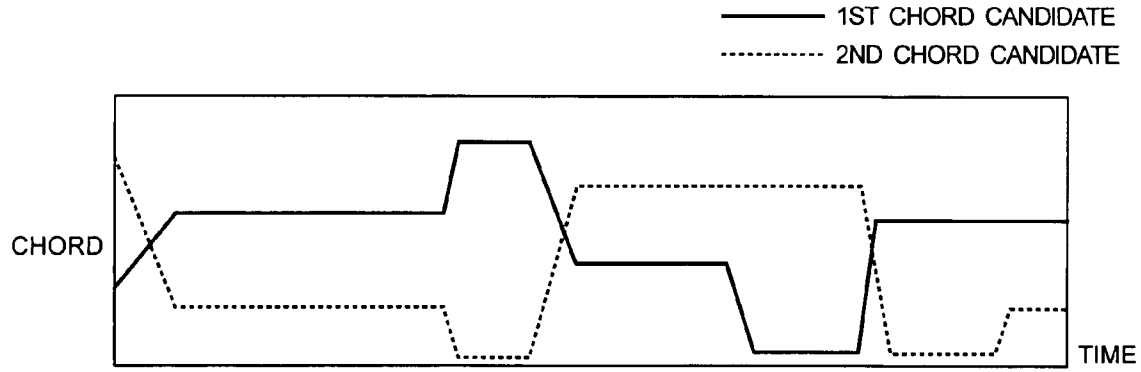

FIG.14B

| | | | | | |
|---|---|---|---|---|---|
| TRANSITION OF 1ST CHORD CANDIDATE | F<br>0×08<br>←TIME (T1(0)) | G<br>0×0A<br>T1(1) | D<br>0×05<br>T1(2) | B♭<br>0×01<br>T1(3) | F<br>0×08<br>T1(4) |

FIG.14C

| | | | | | |
|---|---|---|---|---|---|
| TRANSITION OF 2ND CHORD CANDIDATE | F<br>0×03<br>←TIME (T2(0)) | B♭<br>0×01<br>T2(1) | F#m<br>0×29<br>T2(2) | B♭<br>0×01<br>T2(3) | C<br>0×03<br>T2(4) |

FIG.14D

IDENTIFICATION INFORMATION FOR MUSIC PIECES (FILE NAMES, ETC.) (512 BYTES)

NUMBER OF 1ST CHORD CANDIDATES (4 BYTES) T1(0) (4 BYTES) [0×08] T1(1) (4 BYTES) [0×0A] T1(2) (4 BYTES) [0×05] T1(3) (4 BYTES) [0×01] T1(4) (4 BYTES) [0×08] ·····

NUMBER OF 2ND CHORD CANDIDATES (4 BYTES) T2(0) (4 BYTES) [0×03] T2(1) (4 BYTES) [0×01] T2(2) (4 BYTES) [0×29] T2(3) (4 BYTES) [0×01] T2(4) (4 BYTES) [0×03] ·····

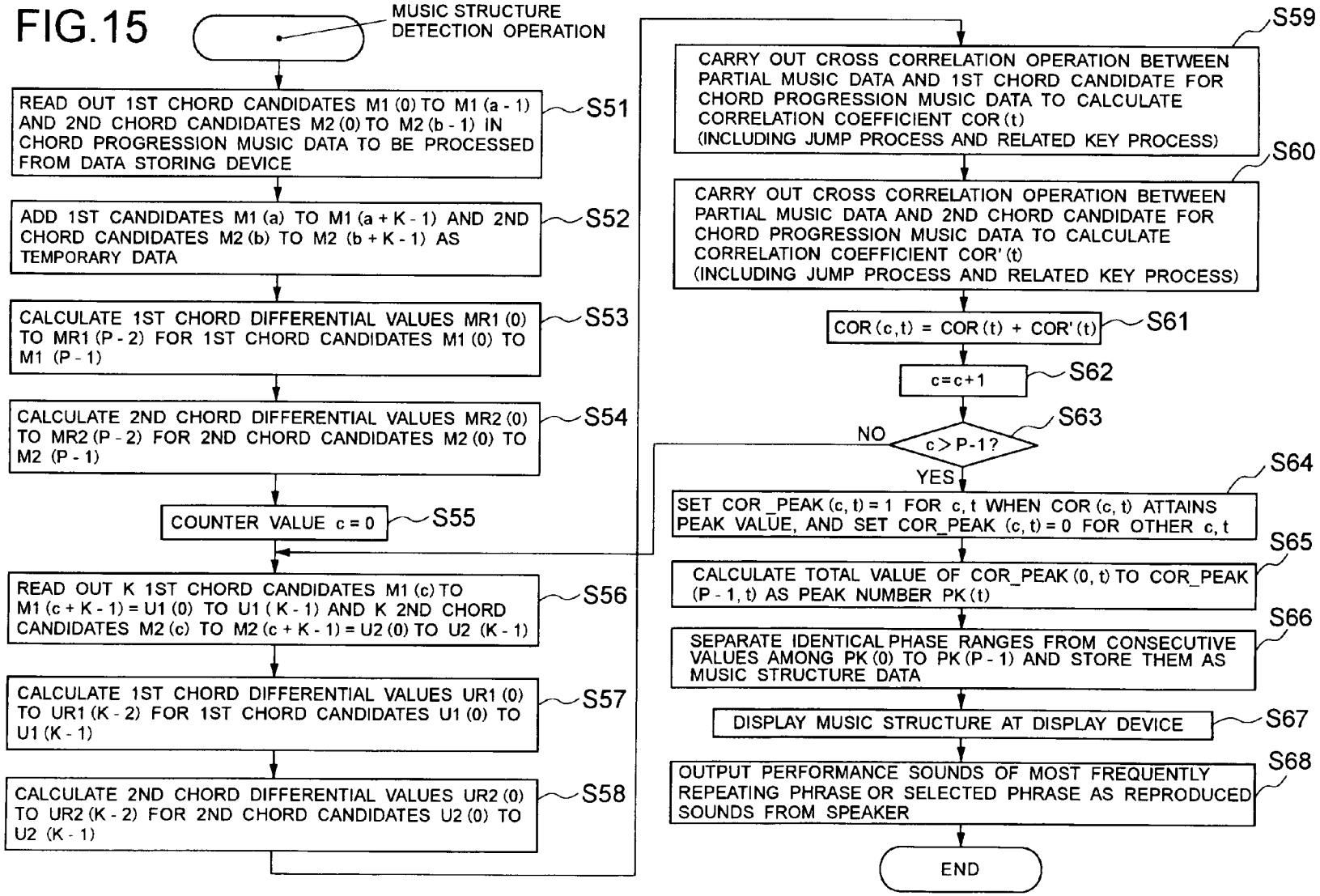
FIG.15
MUSIC STRUCTURE DETECTION OPERATION
S51
READ OUT 1ST CHORD CANDIDATES M1 (0) TO M1 (a - 1) AND 2ND CHORD CANDIDATES M2 (0) TO M2 (b - 1) IN CHORD PROGRESSION MUSIC DATA TO BE PROCESSED FROM DATA STORING DEVICE
S52
ADD 1ST CANDIDATES M1 (a) TO M1 (a + K - 1) AND 2ND CHORD CANDIDATES M2 (b) TO M2 (b + K - 1) AS TEMPORARY DATA
S53
CALCULATE 1ST CHORD DIFFERENTIAL VALUES MR1 (0) TO MR1 (P - 2) FOR 1ST CHORD CANDIDATES M1 (0) TO M1 (P - 1)
S54
CALCULATE 2ND CHORD DIFFERENTIAL VALUES MR2 (0) TO MR2 (P - 2) FOR 2ND CHORD CANDIDATES M2 (0) TO M2 (P - 1)
S55
COUNTER VALUE c = 0
S56
READ OUT K 1ST CHORD CANDIDATES M1 (c) TO M1 (c + K - 1) = U1 (0) TO U1 (K - 1) AND K 2ND CHORD CANDIDATES M2 (c) TO M2 (c + K - 1) = U2 (0) TO U2 (K - 1)
S57
CALCULATE 1ST CHORD DIFFERENTIAL VALUES UR1 (0) TO UR1 (K - 2) FOR 1ST CHORD CANDIDATES U1 (0) TO U1 (K - 1)
S58
CALCULATE 2ND CHORD DIFFERENTIAL VALUES UR2 (0) TO UR2 (K - 2) FOR 2ND CHORD CANDIDATES U2 (0) TO U2 (K - 1)
S59
CARRY OUT CROSS CORRELATION OPERATION BETWEEN PARTIAL MUSIC DATA AND 1ST CHORD CANDIDATE FOR CHORD PROGRESSION MUSIC DATA TO CALCULATE CORRELATION COEFFICIENT COR (t) (INCLUDING JUMP PROCESS AND RELATED KEY PROCESS)
S60
CARRY OUT CROSS CORRELATION OPERATION BETWEEN PARTIAL MUSIC DATA AND 2ND CHORD CANDIDATE FOR CHORD PROGRESSION MUSIC DATA TO CALCULATE CORRELATION COEFFICIENT COR' (t) (INCLUDING JUMP PROCESS AND RELATED KEY PROCESS)
S61
COR (c, t) = COR (t) + COR' (t)
S62
c=c+1
S63
c > P-1 ?
NO
YES
S64
SET COR_PEAK (c, t) = 1 FOR c, t WHEN COR (c, t) ATTAINS PEAK VALUE, AND SET COR_PEAK (c, t) = 0 FOR OTHER c, t
S65
CALCULATE TOTAL VALUE OF COR_PEAK (0, t) TO COR_PEAK (P - 1, t) AS PEAK NUMBER PK (t)
S66
SEPARATE IDENTICAL PHASE RANGES FROM CONSECUTIVE VALUES AMONG PK (0) TO PK (P - 1) AND STORE THEM AS MUSIC STRUCTURE DATA
S67
DISPLAY MUSIC STRUCTURE AT DISPLAY DEVICE
S68
OUTPUT PERFORMANCE SOUNDS OF MOST FREQUENTLY REPEATING PHRASE OR SELECTED PHRASE AS REPRODUCED SOUNDS FROM SPEAKER
END CHORD DIFFERENTIAL VALUE FOR CHORD PROGRESSION MUSIC DATA AND CHORD TIME WIDTH
TIME
t=0
LENGTH K
CHORD DIFFERENTIAL VALUE AND CHORD TIME WIDTH FOR PARTIAL MUSIC DATA PIECE
t=P-1

COR(c, t)
t
POSITION WITH MINIMUM COR(c, t) (POSITION WITH MAXIMUM CORRELATION)
WU(1)
WU(2)
WU(3)
WU(4)
WU(5)
CHORD
TIME
JUMP PROCESS
RELATED KEY PROCESS
WM(1)
WM(2)
WM(3)
WM(4)
WM(5)
CHORD
JUMP PROCESS
TIME

FIG.21

IDENTIFICATION INFORMATION FOR MUSIC PIECES (FILE NAMES, ETC.) (512 BYTES)

REPEATING PART 1 : PHRASE REPEATING THREE TIMES
0×03 (RANK 3, 1 BYTE) 1ST PHRASE STARTING TIME INFORMATION (4 BYTES)
1ST PHRASE ENDING TIME INFORMATION (4 BYTES)

2ND PHRASE STARTING TIME INFORMATION (4 BYTES)
2ND PHRASE ENDING TIME INFORMATION (4 BYTES)

3RD PHRASE STARTING TIME INFORMATION (4 BYTES)
3RD PHRASE ENDING TIME INFORMATION (4 BYTES)

REPEATING PART 2 : PHRASE REPEATING TWICE
0×02 (RANK 2, 1 BYTE) 1ST PHRASE STARTING TIME INFORMATION (4 BYTES)
1ST PHRASE ENDING TIME INFORMATION (4 BYTES)

2ND PHRASE STARTING TIME INFORMATION (4 BYTES)
2ND PHRASE ENDING TIME INFORMATION (4 BYTES)

REPEATING PART 3 : PHRASE REPEATING TWICE
0×02 (RANK 2, 1 BYTE) 1ST PHRASE STARTING TIME INFORMATION (4 BYTES)
1ST PHRASE ENDING TIME INFORMATION (4 BYTES)

2ND PHRASE STARTING TIME INFORMATION (4 BYTES)
2ND PHRASE ENDING TIME INFORMATION (4 BYTES)

REPEATING PART 4 : (ACTUALLY NOT REPEATING, APPEARING ONLY ONCE)
0×01 (RANK 2, 1 BYTE) PHRASE STARTING TIME FORMATION (4 BYTES)
PHRASE ENDING TIME INFORMATION (4 BYTES)
0×01 (RANK 2, 1 BYTE) PHRASE STARTING TIME FORMATION (4 BYTES)
PHRASE ENDING TIME INFORMATION (4 BYTES)
0×01 (RANK 2, 1 BYTE) PHRASE STARTING TIME FORMATION (4 BYTES)
PHRASE ENDING TIME INFORMATION (4 BYTES)

MUSIC STRUCTURE DETECTION APPARATUS AND METHOD

BACKGROUND OF THE INVENTION

1. Field of the Invention

The present invention relates to an apparatus and a method for detecting the structure of a music piece in accordance with data representing chronological changes in chords in the music piece.

2. Description of the Related Background Art

In popular music in general, phrases are expressed as introduction, melody A, melody B and release, and melody A, melody B, and release parts are repeated a number of times, as a refrain. The release phrase for a so-called heightened part of a music piece in particular is more often selectively used than the other parts when the music is included in a music program or a commercial message aired on radio or TV broadcast. Generally, each of the phrases is determined by actually listening to the sound of the music piece before broadcasting.

If how the phrases including the release part of a music piece is repeated, in other words, the overall structure of the music piece can be understood, not only the release part but also the other repeating phrases can easily be selectively played. However, since there has been no such apparatus that automatically detects the overall structure of music pieces, the user has no choice but actually listen to the music to determine phrases as mentioned above.

SUMMARY OF THE INVENTION

It is therefore an object of the invention to provide an apparatus and a method allowing the structure of a music piece including repeating parts to be appropriately detected with a simple structure.

A music structure detection apparatus according to the present invention which detects a structure of a music piece in accordance with chord progression music data representing chronological changes in chords in the music piece, comprising: a partial music data producing device which produces partial music data pieces each including a predetermined number of consecutive chords starting from a position of each chord in the chord progression music data; a comparator which compares each of the partial music data pieces with the chord progression music data from each of the starting chord positions in the chord progression music data, on the basis of an amount of change in a root of a chord in each chord transition and an attribute of the chord after the transition, thereby calculating degrees of similarity for each of the partial music data pieces; a chord position detector which detects a position of a chord in the chord progression music data where the calculated similarity degree indicates a peak value higher than a predetermined value for each of the partial music data pieces; and an output device which calculates the number of times that the calculated similarity degree indicates a peak value higher than the predetermined value for all the partial music data pieces for each chord position in the chord progression music data, thereby producing a detection output representing the structure of the music piece in accordance with the calculated number of times for each chord position.

A method according to the present invention which detects a structure of a music piece in accordance with chord progression music data representing chronological changes in chords in the music piece, the method comprising the steps of: producing partial music data pieces each including a predetermined number of consecutive chords starting from a position of each chord in the chord progression music data; comparing each of the partial music data pieces with the chord progression music data from each of the starting chord positions in the chord progression music data, on the basis of an amount of change in a root of a chord in each chord transition and an attribute of the chord after the transition, thereby calculating degrees of similarity for each of the partial music data pieces; detecting a position of a chord in the chord progression music data where the calculated similarity degree indicates a peak value higher than a predetermined value for each of the partial music data pieces; and calculating the number of times that the calculated similarity degree indicates a peak value higher than the predetermined value for all the partial music data pieces for each chord position in the chord progression music data, thereby producing a detection output representing the structure of the music piece in accordance with the calculated number of times for each chord position.

A computer program product according to the present invention comprising a program for detecting a structure of a music piece, the detecting comprising the steps of: producing partial music data pieces each including a predetermined number of consecutive chords starting from a position of each chord in the chord progression music data; comparing each of the partial music data pieces with and the chord progression music data from each of the starting chord positions in the chord progression music data, on the basis of an amount of change in a root of a chord in each chord transition and an attribute of the chord after the transition, thereby calculating degrees of similarity for each of the partial music data pieces; detecting a position of a chord in the chord progression music data where the calculated similarity degree indicates a peak value higher than a predetermined value for each of the partial music data pieces; and calculating the number of times that the calculated similarity degree indicates a peak value higher than the predetermined value for all the partial music data pieces for each chord position in the chord progression music data, thereby producing a detection output representing the structure of the music piece in accordance with the calculated number of times for each chord position.

BRIEF DESCRIPTION OF THE DRAWINGS

FIG. 3 is a table of ratios of the frequencies of twelve tones and tone A one octave higher with reference to the lower tone A as 1.0;

FIG. 4 is a flow chart showing a main process in chord analysis operation;

FIG. 7 shows how a chord with four tones is transformed into a chord with three tones;

FIG. 8 shows a recording format into a temporary memory;

FIGS. 9A to 9C show method for expressing fundamental notes of chords, their attributes, and a chord candidate;

FIGS. 14A to 14D show how chord progression music data is produced and its format;

FIG. 15 is a flow chart showing music structure detection operation;

FIG. 21 shows the format of music structure data;

DETAILED DESCRIPTION OF THE INVENTION

Hereinafter, embodiments of the present invention will be described in detail with reference to the drawings.

Figure 1:
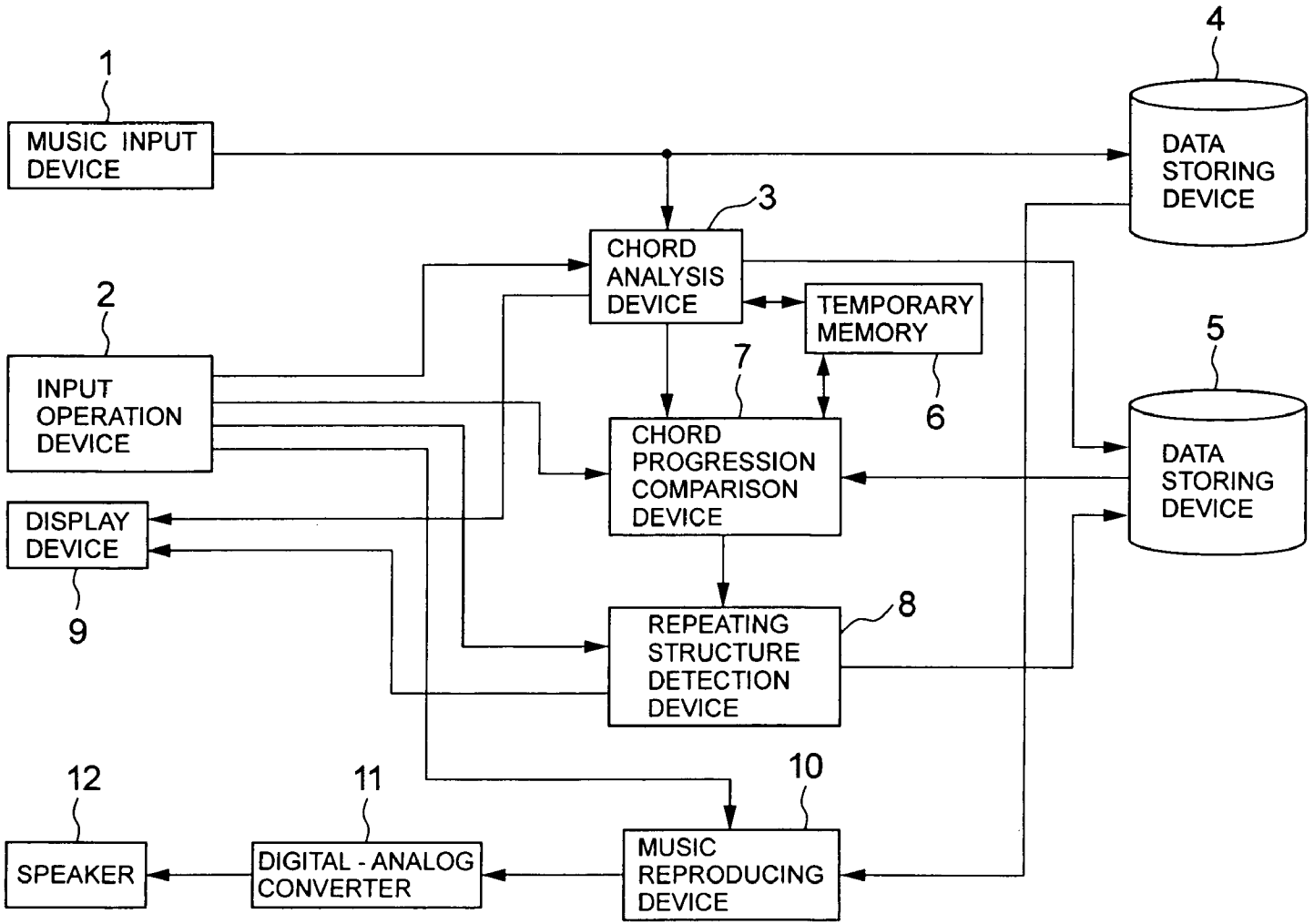
FIG. 1 is a block diagram of the configuration of a music processing system to which the invention is applied.

FIG. 1 shows a music processing system to which the present invention is applied. The music processing system includes a music input device 1, an input operation device 2, a chord analysis device 3, data storing devices 4 and 5, a temporary memory 6, a chord progression comparison device 7, a repeating structure detection device 8, a display device 9, a music reproducing device 10, a digital-analog converter 11, and a speaker 12.

The music input device 1 is, for example, a CD player connected with the chord analysis device 3 and the data storing device 5 to reproduce a digitized audio signal (such as PCM data). The input operation device 2 is a device for a user to operate for inputting data or commands to the system. The output of the input operation device 2 is connected with the chord analysis device 3, the chord progression comparison device 7, the repeating structure detection device 8, and the music reproducing device 10. The data storing device 4 stores the music data (PCM data) supplied from the music input device 1 as files.

The chord analysis device 3 analyzes chords of the supplied music data by chord analysis operation that will be described. The chords of the music data analyzed by the chord analysis device 3 are temporarily stored as first and second chord candidates in the temporary memory 6. The data storing device 5 stores chord progression music data analyzed by the chord analysis device 3 as a file for each music piece.

The chord progression comparison device 7 compares the chord progression music data stored in the data storing device 5 with a partial music data piece that constitutes a part of the chord progression music data to calculate degrees of similarity. The repeating structure detection device 8 detects a repeating part in the music piece using a result of the comparison by the chord progression music comparison device 7.

The display device 9 displays the structure of the music piece including its repeating part detected by the repeating structure detection device 8.

The music reproducing device 10 reads out the music data for the repeating part detected by the repeating structure detection device 8 from the data storing device 4 and reproduces the data for sequential output as a digital audio signal. The digital-analog converter 11 converts the digital audio signal reproduced by the music reproducing device 10 into an analog audio signal for supply to the speaker 12.

The chord analysis device 3, the chord progression comparison device 7, the repeating structure detection device 8, and the music reproducing device 10 operate in response to each command from the input operation device 2.

Now, the operation of the music processing system having the structure will be described.

Here, assume that a digital audio signal representing music sound is supplied from the music input device 1 to the chord analysis device 3.

The chord analysis operation includes a pre-process, a main process, and a post-process. The chord analysis device 3 carries out frequency error detection operation as the pre-process.

Figure 2:
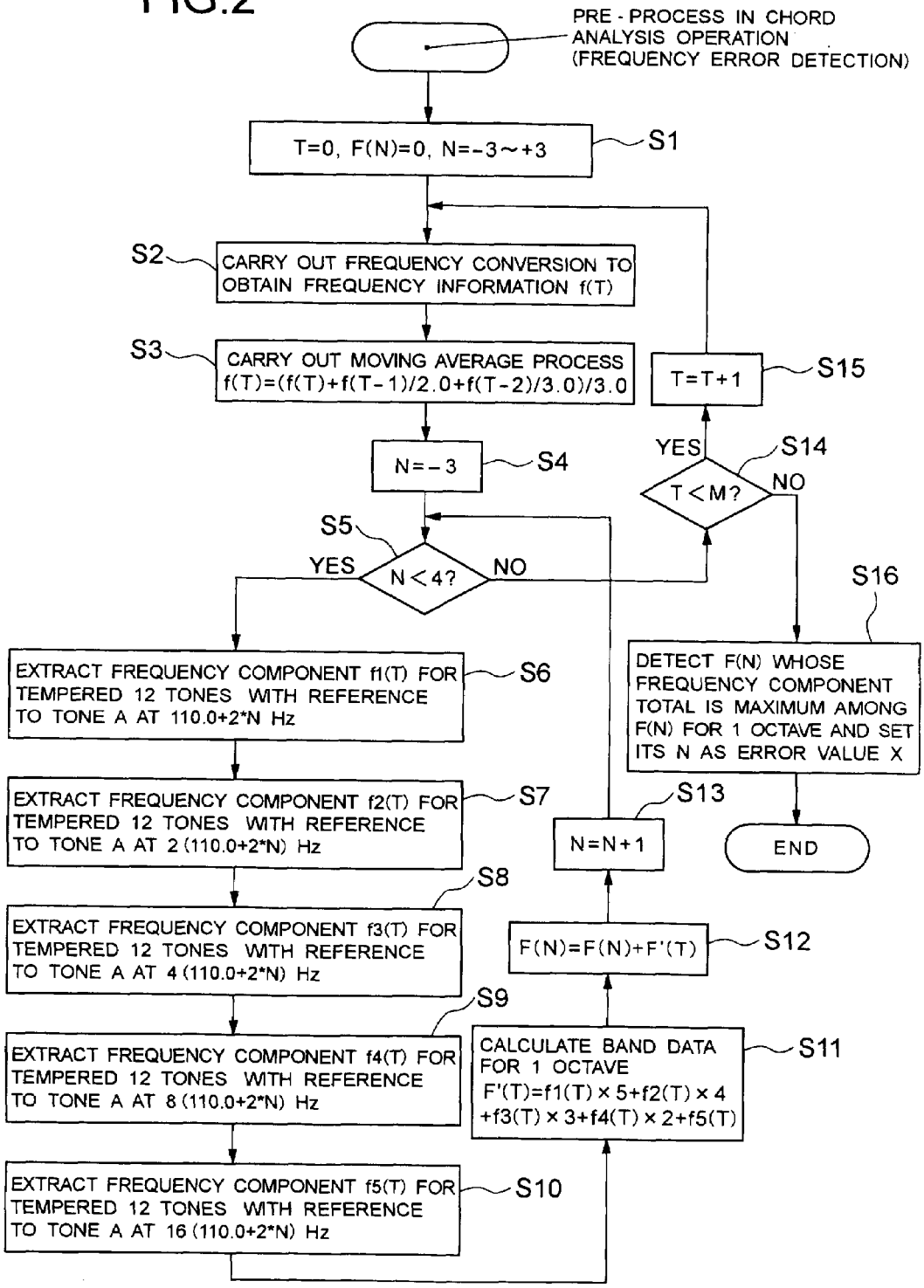
FIG. 2 is a flow chart showing the operation of frequency error detection.

In the frequency error detection operation, as shown in FIG. 2, a time variable T and a band data F(N) each are initialized to zero, and a variable N is initialized, for example, to the range from −3 to 3 (step S1). An input digital signal is subjected to frequency conversion by Fourier transform at intervals of 0.2 seconds, and as a result of the frequency conversion, frequency information f(T) is obtained (step S2).

The present information f(T), previous information f(T−1), and information f(T−2) obtained two times before are used to carry out a moving average process (step S3). In the moving average process, frequency information obtained in two operations in the past are used on the assumption that a chord hardly changes within 0.6 seconds. The moving average process is carried out by the following expression:

$$f(T)=(f(T)+f(T-1)/2.0+f(T-2)/3.0)/3.0 \quad (1)$$

After step S3, the variable N is set to −3 (step S4), and it is determined whether or not the variable N is smaller than 4 (step S5). If N<4, frequency components f1(T) to f5(T) are extracted from the frequency information f(T) after the moving average process (steps S6 to S10). The frequency components f1(T) to f5(T) are in tempered twelve tone scales for five octaves based on 110.0+2×N Hz as the fundamental frequency. The twelve tones are A, A#, B, C, C#, D, D#, E, F, F#, G, and G#. FIG. 3 shows frequency ratios of the twelve tones and tone A one octave higher with reference to the lower tone A as 1.0. Tone A is at 110.0+2×N Hz for f1(T) in step S6, at 2×(110.0+2×N)Hz for f2(T) in step S7, at 4×(110.0+2×N)Hz for f3(T) in step S8, at 8×(110.0+2×N)Hz for f4(T) in step S9, and at 16×(110.0+2×N)Hz for f5(T) in step 10.

After steps S6 to S10, the frequency components f1(T) to f5(T) are converted into band data F' (T) for one octave (step S11). The band data F' (T) is expressed as follows:

$$F'(T)=f1(T)\times 5+f2(T)\times 4+f3(T)\times 3+f4(T)\times 2+f5(T) \quad (2)$$

More specifically, the frequency components f1(T) to f5(T) are respectively weighted and then added to each other. The band data F' (T) for one octave is added to the band data F(N) (step S12). Then, one is added to the variable N (step S13), and step S5 is again carried out.

The operations in steps S6 to S13 are repeated as long as N<4 stands in step S5, in other words, as long as N is in the range from −3 to +3. Consequently, the tone component F(N) is a frequency component for one octave including tone interval errors in the range from −3 to +3.

If N≧4 in step S5, it is determined whether or not the variable T is smaller than a predetermined value M (step S14). If T<M, one is added to the variable T (step S15), and step S2 is again carried out. Band data F(N) for each variable N for frequency information f(T) by M frequency conversion operations is produced.

If T≧M in step S14, in the band data F(N) for one octave for each variable N, F(N) having the frequency components whose total is maximum is detected, and N in the detected F(N) is set as an error value X (step S16).

In the case of existing a certain difference between the tone intervals of an entire music sound such as a performance sound by an orchestra, the tone intervals can be compensated by obtaining the error value X by the pre-process, and the following main process for analyzing chords can be carried out accordingly.

Once the operation of detecting frequency errors in the pre-process ends, the main process for analyzing chords is carried out. Note that if the error value X is available in advance or the error is insignificant enough to be ignored, the pre-process can be omitted. In the main process, chord analysis is carried out from start to finish for a music piece, and therefore an input digital signal is supplied to the chord analysis device 3 from the starting part of the music piece.

As shown in FIG. 4, in the main process, frequency conversion by Fourier transform is carried out to the input digital signal at intervals of 0.2 seconds, and frequency information f(T) is obtained (step S21). This step S21 corresponds to a frequency converter (FOR EP: conversion means). The present information f(T), the previous information f(T−1), and the information f(T−2) obtained two times before are used to carry out moving average process (step S22). The steps S21 and S22 are carried out in the same manner as steps S2 and S3 as described above.

After step S22, frequency components f1(T) to f5(T) are extracted from frequency information f(T) after the moving average process (steps S23 to S27). Similarly to the above described steps S6 to S10, the frequency components f1(T) to f5(T) are in the tempered twelve tone scales for five octaves based on 110.0+2×N Hz as the fundamental frequency. The twelve tones are A, A#, B, C, C#, D, D#, E, F, F#, G, and G#. Tone A is at 110.0+2×N Hz for f1(T) in step S23, at 2×(110.0+2×N)Hz for f2(T) in step S24, at 4×(110.0+2×N)Hz for f3(T) in step S25, at 8×(110.0+2×N) Hz for f4(T) in step S26, and at 16×(110.0+2×N)Hz for f5(T) in step 27. Here, N is X set in step S16.

After steps S23 to S27, the frequency components f1(T) to f5(T) are converted into band data F' (T) for one octave (step S28). The operation in step S28 is carried out using the expression (2) in the same manner as step S11 described above. The band data F' (T) includes tone components. These steps S23 to S28 correspond to a component extractor (FOR EP: extraction means).

After step S28, the six tones having the largest intensity levels among the tone components in the band data F' (T) are selected as candidates (step S29), and two chords M1 and M2 of the six candidates are produced (step S30). One of the six candidate tones is used as a root to produce a chord with three tones. More specifically, ${}_6C_3$ chords are considered. The levels of three tones forming each chord are added. The chord whose addition result value is the largest is set as the first chord candidate M1, and the chord having the second largest addition result is set as the second chord candidate M2.

Figure 5:
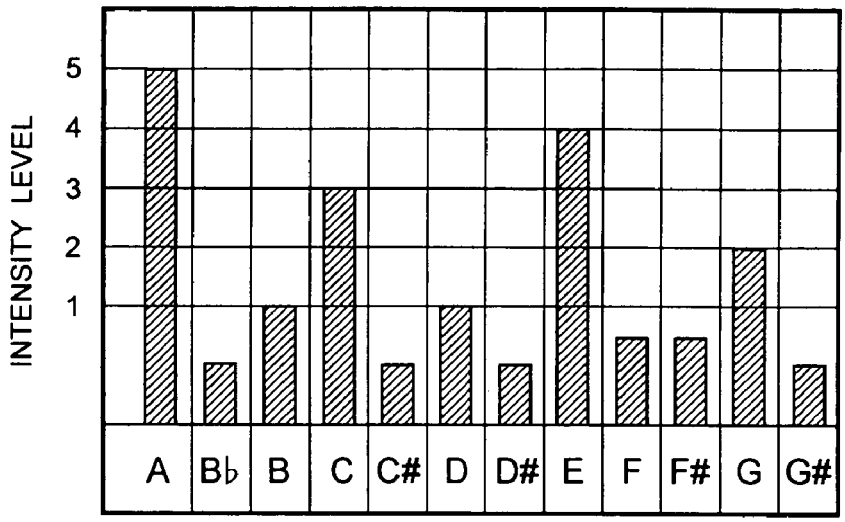
FIG. 5 is a graph showing one example of the intensity levels of tone components in band data.

When the tone components of the band data F' (T) show the intensity levels for twelve tones as shown in FIG. 5, six tones, A, E, C, G, B, and D are selected in step S29. Triads each having three tones from these six tones A, E, C, G, B, and D are chord Am (of tones A, C, and E), chord C (of tones C, E, and G), chord Em (of tones E, B, and G), chord G (of tones G, B, and D), . . . . The total intensity levels of chord Am (A, C, E), chord C (C, E, G), chord Em (E, B, G), and chord G (G, B, D) are 12, 9, 7, and 4, respectively. Consequently, in step S30, chord Am whose total intensity level is the largest, i.e., 12 is set as the first chord candidate M1. Chord C whose total intensity level is the second largest, i.e., 7 is set as the second chord candidate M2.

Figure 6:
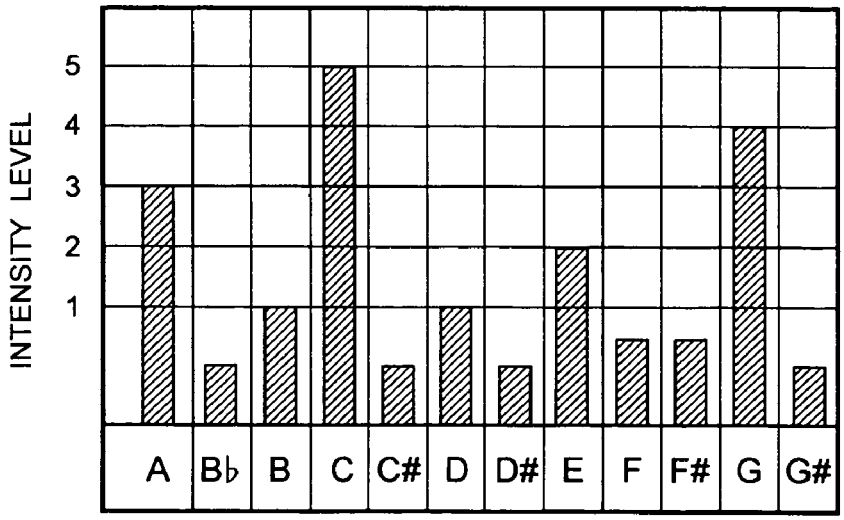
FIG. 6 is a graph showing another example of the intensity levels of tone components in band data.

When the tone components in the band data F' (T) show the intensity levels for the twelve tones as shown in FIG. 6, six tones C, G, A, E, B, and D are selected in step S29. Triads produced from three tones selected from these six tones C, G, A, E, B, and D are chord C (of tones C, E, and G), chord Am (of A, C, and E), chord Em (of E, B, and G), chord G (of G, B, and D), . . . . The total intensity levels of chord C (C, E, G), chord Am (A, C, E), chord Em (E, B, G), and chord G (G, B, D) are 11, 10, 7, and 6, respectively. Consequently, chord C whose total intensity level is the largest, i.e., 11 in step S30 is set as the first chord candidate M1. Chord Am whose total intensity level is the second largest, i.e., 10 is set as the second chord candidate M2.

The number of tones forming a chord does not have to be three, and there is, for example, a chord with four tones such as 7th and diminished 7th. Chords with four tones are divided into two or more chords each having three tones as shown in FIG. 7. Therefore, similarly to the above chords of three tones, two chord candidates can be set for these chords of four tones in accordance with the intensity levels of the tone components in the band data F' (T).

After step S30, it is determined whether or not there are chords as many as the number set in step S30 (step S31). If the difference in the intensity level is not large enough to select at least three tones in step 30, no chord candidate is set. This is why step S31 is carried out. If the number of chord candidates >0, it is then determined whether the number of chord candidates is greater than one (step S32).

If it is determined in step S31 that the number of chord candidates =0, the chord candidates M1 and M2 set in the previous main process at T−1 (about 0.2 seconds before) are set as the present chord candidates M1 and M2 (step S33). If the number of chord candidates =1 in step S32, it means that only the first candidate M1has been set in the present step S30, and therefore the second chord candidate M2 is set as the same chord as the first chord candidate M1 (step S34). These steps S29 to S34 correspond to a chord candidate detector (FOR EP: detection means).

If it is determined that the number of chord candidates >1 in step S32, it means that both the first and second chord candidates M1 and M2 are set in the present step S30, and therefore, time, and the first and second chord candidates M1 and M2 are stored in the temporary memory 6 (step S35). The time and first and second chord candidates M1 and M2 are stored as a set in the temporary memory 6 as shown in FIG. 8. The time is the number of how many times the main process is carried out and represented by T incremented for each 0.2 seconds. The first and second chord candidates M1 and M2 are stored in the order of T.

More specifically, a combination of a fundamental tone (root) and its attribute is used in order to store each chord candidate on a 1-byte basis in the temporary memory 6 as shown in FIG. 8. The fundamental tone indicates one of the tempered twelve tones, and the attribute indicates a type of chord such as major {4, 3}, minor {3, 4}, 7th candidate {4, 6}, and diminished 7th (dim7) candidate {3, 3}. The numbers in the braces { } represent the difference among three tones when a semitone is 1. A typical candidate for 7th is {4, 3, 3}, and a typical diminished 7th (dim7) candidate is {3, 3, 3}, but the above expression is employed in order to express them with three tones.

As shown in FIG. 9A, the 12 fundamental tones are each expressed on a 16-bit basis (in hexadecimal notation). As shown in FIG. 9B, each attribute, which indicates a chord type, is represented on a 16-bit basis (in hexadecimal notation). The lower order four bits of a fundamental tone and the lower order four bits of its attribute are combined in that order, and used as a chord candidate in the form of eight bits (one byte) as shown in FIG. 9C.

Step S35 is also carried out immediately after step S33 or S34 is carried out.

After step S35 is carried out, it is determined whether the music has ended (step S36). If, for example, there is no longer an input analog audio signal, or if there is an input operation indicating the end of the music from the input operation device 2, it is determined that the music has ended. The main process ends accordingly.

Until the end of the music is determined, one is added to the variable T (step S37), and step S21 is carried out again. Step S21 is carried out at intervals of 0.2 seconds, in other words, the process is carried out again after 0.2 seconds from the previous execution of the process.

Figure 10:
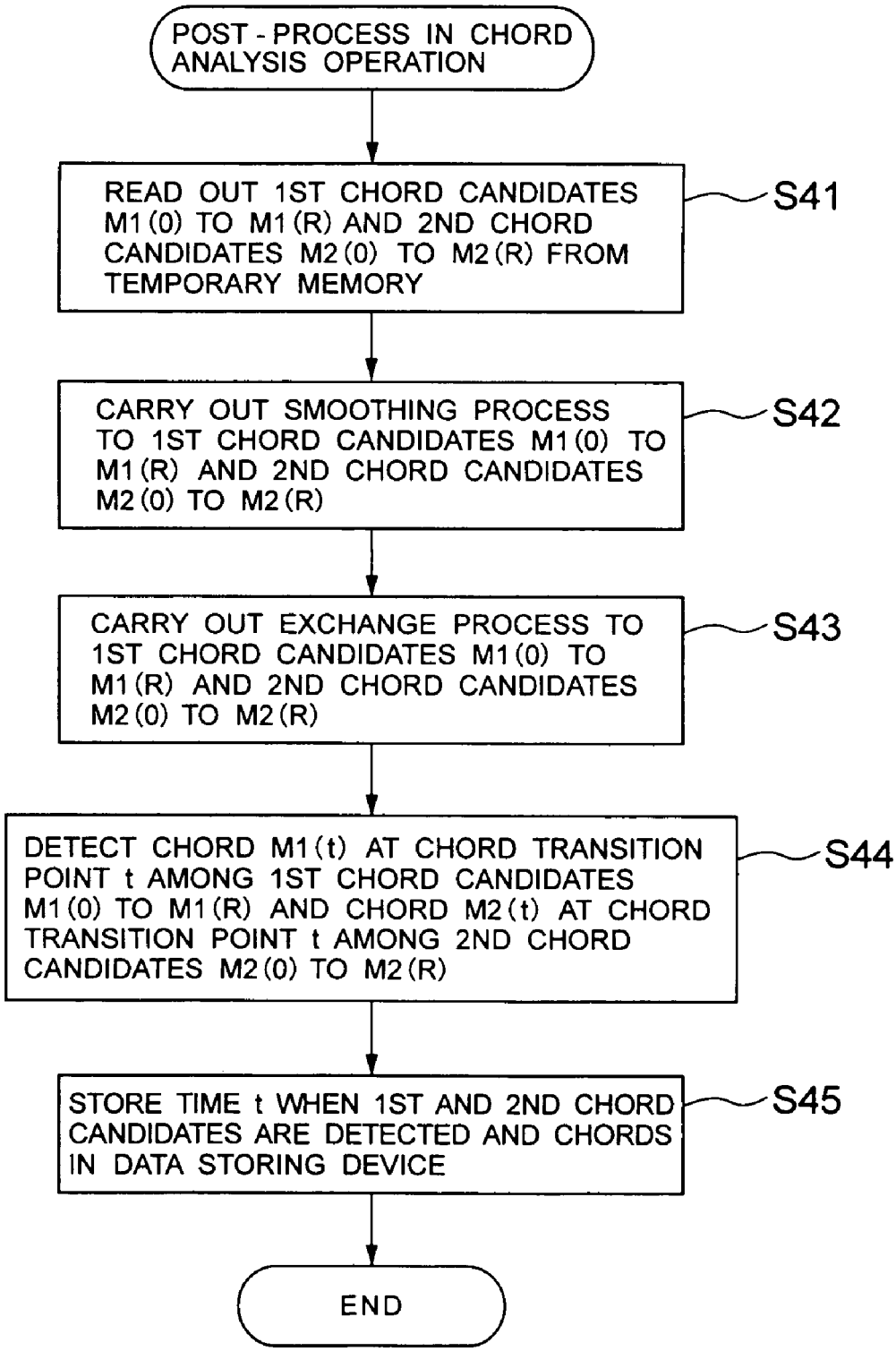
FIG. 10 is a flow chart showing a post-process in chord analysis operation.

In the post-process, as shown in FIG. 10, all the first and second chord candidates M1(0) to M1(R) and M2(0) to M2(R) are read out from the temporary memory 6 (step S41). Zero represents the starting point and the first and second chord candidates at the starting point are M1(0) and M2(0). The letter R represents the ending point and the first and second chord candidates at the ending point are M1(R) and M2(R). These first chord candidates M1(0) to M1(R) and the second chord candidates M2(0) to M2(R) thus read out are subjected to smoothing (step S42). The smoothing is carried out to cancel errors caused by noise included in the chord candidates when the candidates are detected at the intervals of 0.2 seconds regardless of transition points of the chords. As a specific method of smoothing, it is determined whether or not a relation represented by M1(t−1)≠M1(t) and M1(t)≠M1(t+1) stand for three consecutive first chord candidates M1(t−1), M1(t) and M1(t+1). If the relation is established, M1(t) is equalized to M1(t+1). The determination process is carried out for each of the first chord candidates. Smoothing is carried out to the second chord candidates in the same manner. Note that rather than equalizing M1(t) to M1(t+1), M1(t+1) may be equalized to M1(t).

After the smoothing, the first and second chord candidates are exchanged (step S43). There is little possibility that a chord changes in a period as short as 0.6 seconds. However, the frequency characteristic of the signal input stage and noise at the time of signal input can cause the frequency of each tone component in the band data F' (T) to fluctuate, so that the first and second chord candidates can be exchanged within 0.6 seconds. Step S43 is carried out as a remedy for the possibility. As a specific method of exchanging the first and second chord candidates, the following determination is carried out for five consecutive first chord candidates M1(t−2), M1(t−1), M1(t), M1(t+1), and M1(t+2) and five second consecutive chord candidates M2(t−2), M2(t−1), M2(t), M2(t+1), and M2(t+2) corresponding to the first candidates. More specifically, it is determined whether a relation represented by M1(t−2)=M1(t+2), M2(t−2)=M2(t+2), M1(t+1)=M1(t)=M1(t+1)=M2(t+2), and M2(t−1)=M2(t)=M2(t+1)=M1(t−2) is established. If the relation is established, M1(t−1)=M1(t)=M1(t+1)=M1(t−2) and M2(t−1)=M2(t)=M2(t+1)=M2(t−2) are determined, and the chords are exchanged between M1(t−2) and M2(t−2). Note that chords may be exchanged between M1(t+2) and M2(t+2) instead of between M1(t−2) and M2(t−2). It is also determined whether or not a relation represented by M1(t−2)=M1(t+1), M2(t−2)=M2(t+1), M1(t−1)=M(t)=M1(t+1)=M2(t−2) and M2(t−1)=M2(t)=M 2(t+1)=M1(t−2) is established. If the relation is established, M1(t−1)=M(t)=M1(t−2) and M2(t−1)=M2(t)=M2(t−2) are determined, and the chords are exchanged between M1(t−2) and M2(t−2). The chords may be exchanged between M1(t+1)and M2(t+1) instead of between M1(t−2) and M2(t−2).

Figure 11:
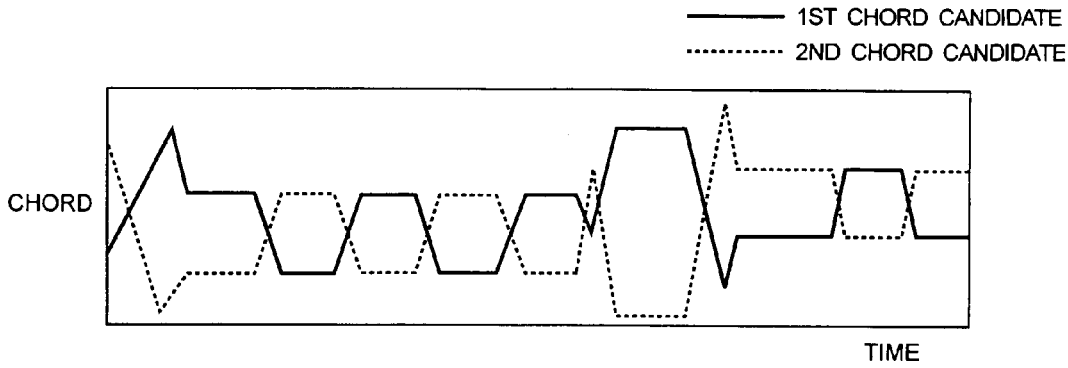
FIG. 11 shows chronological changes in first and second chord candidates before a smoothing process.
Figure 12:
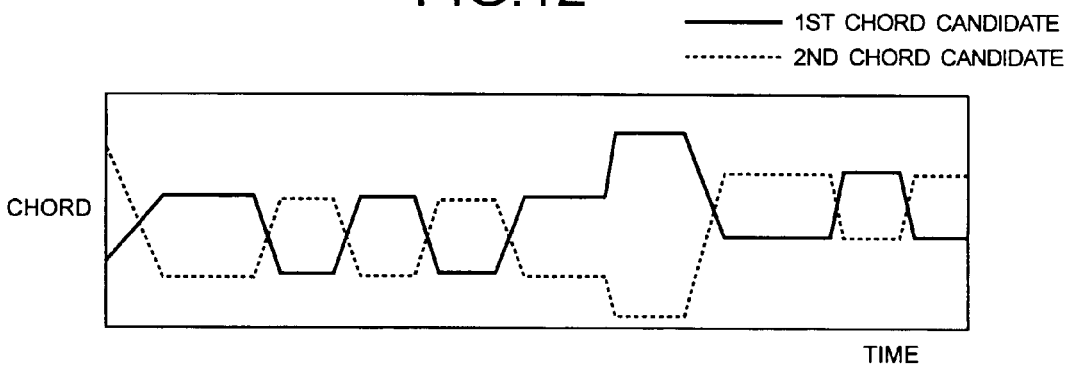
FIG. 12 shows chronological changes in first and second chord candidates after the smoothing process.
Figure 13:
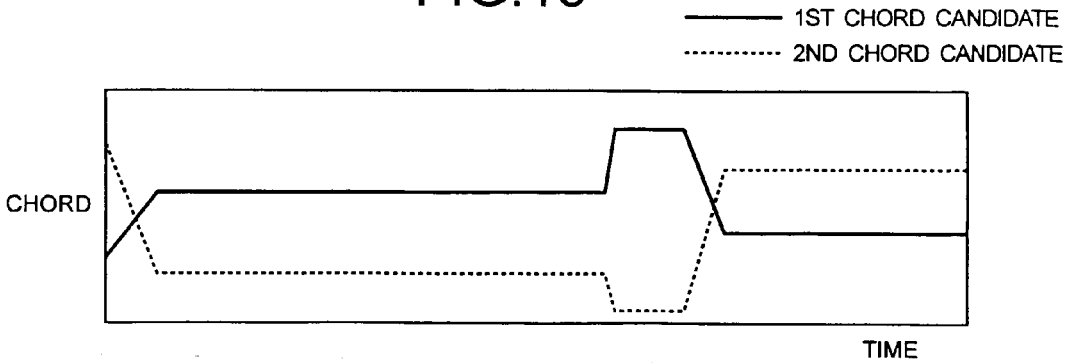
FIG. 13 shows chronological changes in first and second chord candidates after an exchanging process.

The first chord candidates M1(0) to M1(R) and the second chord candidates M2(0) to M2(R) read out in step S41, for example, change with time as shown in FIG. 11, the averaging in step S42 is carried out to obtain a corrected result as shown in FIG. 12. In addition, the chord exchange in step S43 corrects the fluctuations of the first and second chord candidates as shown in FIG. 13. Note that FIGS. 11 to 13 show changes in the chords by a line graph in which positions on the vertical line correspond to the kinds of chords.

The candidate M1(t) at a chord transition point t of the first chord candidates M1(0) to M1(R) and M2(t) at the chord transition point t of the second chord candidates M2(0) to M2(R) after the chord exchange in step S43 are detected (step S44), and the detection point t (4 bytes) and the chord (4 bytes) are stored for each of the first and second chord candidates in the data storing device 5 (step S45). Data for one music piece stored in step S45 is chord progression music data. These steps S41 to S45 correspond to a smoothing device (FOR EP: smoothing means).

When the first and second chord candidates M1(0) to M1(R) and M2(0) to M2(R), after exchanging the chords in step S43, fluctuate with time as shown in FIG. 14A, the time and chords at transition points are extracted as data. FIG. 14B shows the content of data at transition points among the first chord candidates F, G, D, Bb (B flat), and F that are expressed as hexadecimal data 0×08, 0×0A, 0×05, 0×01, and 0×08. The transition points t are T1(0), T1(1), T1(2), T1(3), and T1(4). FIG. 14C shows data contents at transition points among the second chord candidates C, Bb, F#m, Bb, and C that are expressed as hexadecimal data 0×03, 0×01, 0×29, 0×01, and 0×03. The transition points t are T2(0), T2(1), T2(2), T2(3), and T2(4). The data contents shown in FIGS. 14B and 14C are stored together with the identification information of the music piece in the data storing device 5 in step S45 as a file in the form as shown in FIG. 14D.

The chord analysis operation described above is repeatedly carried out for audio signals representing sounds of different music pieces, so that chord progression music data is stored in the data storing device 5 as files for a plurality of music pieces. Note that music data of PCM signals corresponding to the chord progression music data in the data storing device 5 is stored in the data storing device 4.

A first chord candidate in a chord transition point among the first chord candidates and a second chord candidate in a chord transition point among second chord candidates are detected in step S44, and they are final chord progression music data. Therefore, the capacity per music piece can be reduced even as compared to compression data such as MP3-formatted data, and data for each music piece can be processed at high speed.

The chord progression music data written in the data storing device 5 is chord data temporally in synchronization with the actual music. Therefore, when the chords are actually reproduced by the music reproducing device 10 using only the first chord candidate or the logical sum output of the first and second chord candidates, the accompaniment can be played to the music.

Now, the operation of detecting the structure of a music piece stored in the data storing device 5 as chord progression music data will be described. The music structure detection operation is carried out by the chord progression comparison device 7 and the repeating structure detection device 8.

As shown in FIG. 15, in the music structure detection operation, first chord candidates M1(0) to M1(a−1) and second chord candidates M2(0) to M2(b−1) for a music piece whose structure is to be detected are read out from the data storing device 5 serving as the storing means (step S51). The music piece whose structure is to be detected is, for example, designated by operating the input operation device 2. The letter a represents the total number of the first chord candidates, and b represents the total number of the second chord candidates. First chord candidates M1(a) to M1(a+K−1) and second chord candidates M2(b) to M2(b+K−1) each as many as K are provided as temporary data (step S52). Here, if a <b, the total chord numbers P of the first and second chord candidates in the temporary data are each equal to a, and if a ≧b, the total chord number P is equal to b. The temporary data is added following the first chord candidates M1(0) to M1(a−1) and second chord candidates M2(0) to M2(b−1).

First chord differential values MR1(0) to MR1(P−2) are calculated for the read out first chord candidates M1(0) to M1(P−1) (step S53). The first chord differential values are calculated as MR1(0)=M1(1)−M1(0), MR1(1)=M1(2)−M1(1), . . . ; and MR1(P−2)=M1(P−1)−M1(P−2). In the calculation, it is determined whether or not the first chord differential values MR1(0) to MR1(P−2) are each smaller than zero, and 12 is added to the first chord differential values that are smaller than zero. Chord attributes MA1(0) to MA1(P−2) after chord transition are added to the first chord differential values MR1(0) to MR1(P−2), respectively. Second chord differential values MR2(0) to MR2(P−2) are calculated for the read out second chord candidates M2(0) to M2(P−1) (step S54). The second chord differential values are calculated as MR2(0)=M2(1)−M2(0), MR2(1)=M2(2)−M2(1), . . . , and MR2(P−2)=M2(P−1)−M2(P−2). In the calculation, it is determined whether or not the second chord differential values MR2(0) to MR2(P−2) are each smaller than zero, and 12 is added to the second chord differential values that are smaller than zero. Chord attributes MA2(0) to MA2(P−2) after the chord transition are added to the second chord differential values MR2(0) to MR2(P−2), respectively. Note that values shown in FIG. 9B are used for the chord attributes MA1(0) to MA1(P−2), and MA2(0) to MA2(P−2).

Figure 16:
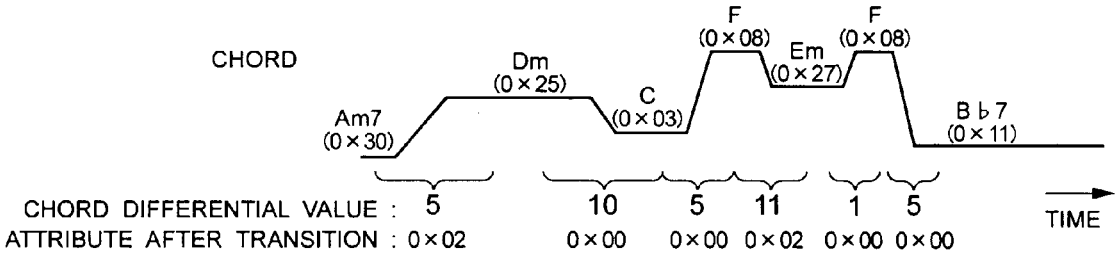
FIG. 16 is a chart showing a chord differential value in a chord transition and the attribute after the transition.

FIG. 16 shows an example of the operation in steps S53 and S54. More specifically, when the chord candidates are in a row of Am7, Dm, C, F, Em, F, and Bb# (B flat sharp), the chord differential values are 5, 10, 5, 11, 1, and 5, and the chord attributes after transition are 0×02, 0×00, 0×00, 0×02, 0×00, and 0×00. Note that if the chord attribute after transition is 7th, major is used instead. This is for the purpose of reducing the amount of operation because the use of 7th hardly affects a result of the comparison operation.

Figure 17:
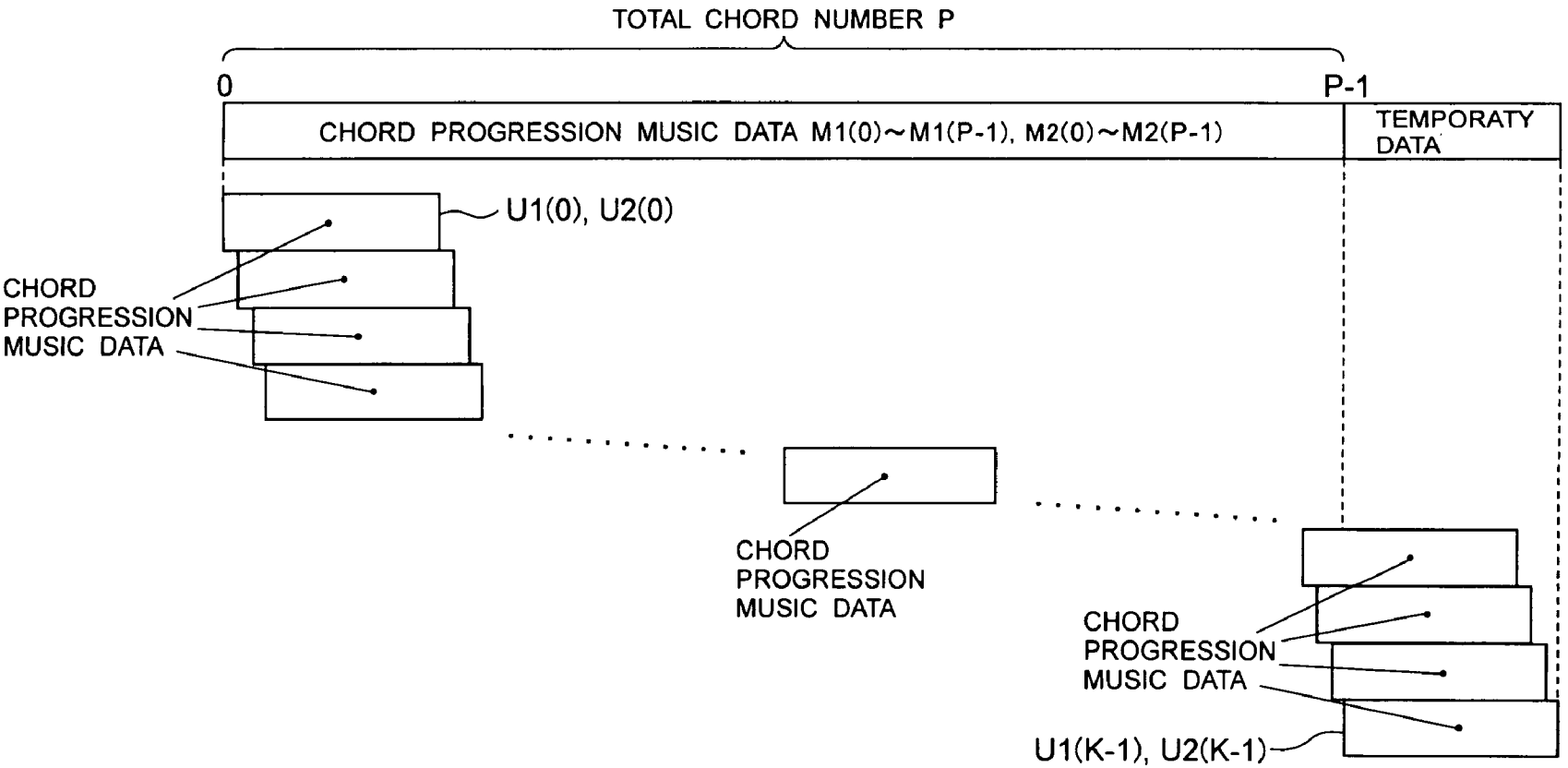
FIG. 17 shows the relation between chord progression music data including temporary data and partial music data.

After step S54, the counter value c is initialized to zero (step S55). Chord candidates (partial music data pieces) as many as K (for example 20) starting from the c-th candidate are extracted each from the first chord candidates M1(0) to M1(P−1) and the second chord candidates M2(0) to M2(P−1) (step S56). More specifically, the first chord candidates M1(c) to M1(c+K−1) and the second chord candidates M2(c) to M2(c+K−1) are extracted. Here, M1(c) to M1(c+K−1)=U1(0) to U1(K−1), and M2(c) to M2(c+K−1)=U2(0) to U2(K−1). FIG. 17 shows how U1(0) to U1(K−1) and U2(0) to U2(K−1) are related to the chord progression music data M1(0) to M1(P−1) and M2(0) to M2(P−1) to be processed and the added temporary data.

After step S56, first chord differential values UR1(0) to UR1(K−2) are calculated for the first chord candidates U1(0) to U1(K−1) for the partial music data piece (step S57). The first chord differential values in step S57 are calculated as UR1(0)=U1(1)−U1(0), UR1(1)=U1(2)−U1(1), . . . , and UR1(K−2)=U1(K−1)−U1(K−2). In the calculation, it is determined whether or not the first chord differential values UR1(0) to UR1(K−2) are each smaller than zero, and 12 is added to the first chord differential values that are smaller than zero. Chord attributes UA1(0) to UA1(K−2) after the chord transition are added to the first chord differential values UR1(0) to UR1(K−2), respectively. The second chord differential values UR2(0) to UR2(K−2) are calculated for the second chord candidates U2(0) to U2(K−1) for the partial music data piece, respectively (step S58). The second chord differential values are calculated as UR2(0)=U2(1)−U2(0), UR2(1)=U2(2)−U2(1), . . . , and UR2(K −2)=U2(K−1)−U2(K−2). In the calculation, it is also determined whether or not the second chord differential values UR2(0) to UR2(K−2) are each smaller than zero, and 12 is added to the second chord differential values that are smaller than zero. Chord attributes UA2(0) to UA2(K−2) after chord transition are added to the second chord differential values UR2(0) to UR2(K−2), respectively.

Cross correlation operation is carried out based on the first chord differential values MR1(0) to MR1(K−2) and the chord attributes MA1(0) to MA1(K−2) obtained in the step S53, K first chord candidates UR1(0) to UR1(K−2) starting from the c-th candidate and the chord attributes UA1(0) to UA1(K−2) obtained in step S57, and K second chord candidates UR2(0 to UR2(K−2) starting from the c-th candidate and the chord attributes UA2(0) to UA2(K−2) obtained in step S58 (step S59). In the cross correlation operation, the correlation coefficient COR(t) is produced from the following expression (3). The smaller the correlation coefficient COR(t) is, the higher the similarity is.

$$COR(t)=\Sigma 10(|MR1(t+k)-UR1(k')|+|MA1(t+k)-UA1(k')|+|WM1(t+k+1)/WM1(t+k)-WU1(k'+1)/WU1(k')|)+\Sigma 10(|MR1\ (t+k)-UR2(k')|+|MA1(t+k)-UA2(k')|+|WM1(t+k+1)/WM1(t+k)-WU2(k'+1)/WU2(k')|) \quad (3)$$

where WU1( ), WM1( ), and WU2( ) are time widths for which the chords are maintained, t=0 to P−1, and Σ operations are for k=0 to K−2 and k'=0 to K−2.

The correlation coefficient COR(t) in step S59 is produced as t is in the range from 0 to P−1. In the operation of the correlation coefficient COR(t) in step S59, a jump process is carried out. In the jump process, the minimum value for MR1(t+k+k1)−UR1(k'+k2) or MR1 (t+k+k1)−UR 2(k'+k2) is detected. The values k1 and k2 are each an integer in the range from 0 to 2. More specifically, as k1 and k2 are changed in the range from 0 to 2, the point where MR1(t+k+k1)−UR1(k'+k2) or MR1(t+k+k1)−UR2(k'+k2) is minimized is detected. The value k+k1 at the point is set as a new k, and k'+k2 is set as a new k'. Then, the correlation coefficient COR(t) is calculated according to the expression (3).

If chords after respective chord transitions at the same point in both of the chord progression music data to be processed and K partial music data pieces from the c-th piece of the chord progression music data are either C or Am or either Cm or Eb (E flat), the chords are regarded as being the same. More specifically, as long as the chords after the transitions is chords of a related key, |MR1(t+k)−UR1(k')|+|MA1(t+k)−UA1(k')|=0 or |MR1(t+k)−UR2(k')|+|MA1(t+k)−UA2(k')|=0 in the above expression stands. For example, the transform of data from chord F to major by a difference of seven degrees, and the transform of the other data to minor by a difference of four degrees are regarded as the same. Similarly, the transform of data from chord F to minor by a difference of seven degrees and the transform of the other data to major by a difference of ten degrees are treated as the same.

The cross-correlation operation is carried out based on the second chord differential values MR2(0) to MR2(K−2) and the chord attributes MA2(0) to MA2(K−2) obtained in step S54, and K first chord candidates UR1(0) to UR1(K−2) from c-th candidate and the chord attributes UA1(0) to UA1(K−2) obtained in step S57, and K second chord candidates UR2(0) to UR2(K−2) from the c-th candidate and the chord attributes UA2(0) to UA2(K−2) obtained in step S58 (step S60). In the cross-correlation operation, the correlation coefficient COR'(t) is calculated by the following expression (4). The smaller the correlation coefficient COR'(t) is, the higher the similarity is.

$$COR'(t)=\Sigma 10(|MR2(t+k)-UR1(k')|+|MA2(t+k)-UA1(k')|+|WM2(t+k+1)/WM2(t+k)-WU1(k'+1)/WU1(k')|)+\Sigma 10(|MR2(t+k)-UR2(k')|+|MA2(t+k)-UA2(k')|+|WM2(t+k+1)/WM2(t+k)-WU2(k'+1)/WU2(k')|) \quad (4)$$

where WU1( ), WM2( ), and WU2( ) are time widths for which the chords are maintained, t=0 to P−1, Σ operations are for k=0 to K−2 and k'=0 to K−2.

The correlation coefficient COR'(t) in step S60 is produced as t changes in the range from 0 to P−1. In the operation of the correlation coefficient COR(t) in step S60, a jump process is carried out similarly to step S59 described above. In the jump process, the minimum value for MR2(t+k+k1)−UR1(k'+k2) or MR2(t+k+k1)−UR2(k'+k2) is detected. The values k1 and k2 are each an integer from 0 to 2. More specifically, k1 and k2 are each changed in the range from 0 to 2, and the point where MR2(t+k+k1)−UR1(k'+k2 ) or MR2(t+k+k1)−UR2(k'+k2) is minimized is detected. Then, k+k1 at the point is set as a new k, and k'+k2 is set as a new k'. Then, the correlation coefficient COR'(t) is calculated according to the expression (4).

If chords after respective chord transitions at the same point in both of the chord progression music data to be processed and the partial music data piece are either C or Am or either Cm or Eb, the chords are regarded as being the same. More specifically, as long as the chords after the transitions are chords of a related key, |MR2(t+k)−UR1(k')|+|MA2(t+k)−UA1(k')|=0 or |MR2(t+k)−UR2(k')|+|MA2(t+k)−UA2(k') |=0 in the above expression stands.

Figures 18A, 18B, 18C:
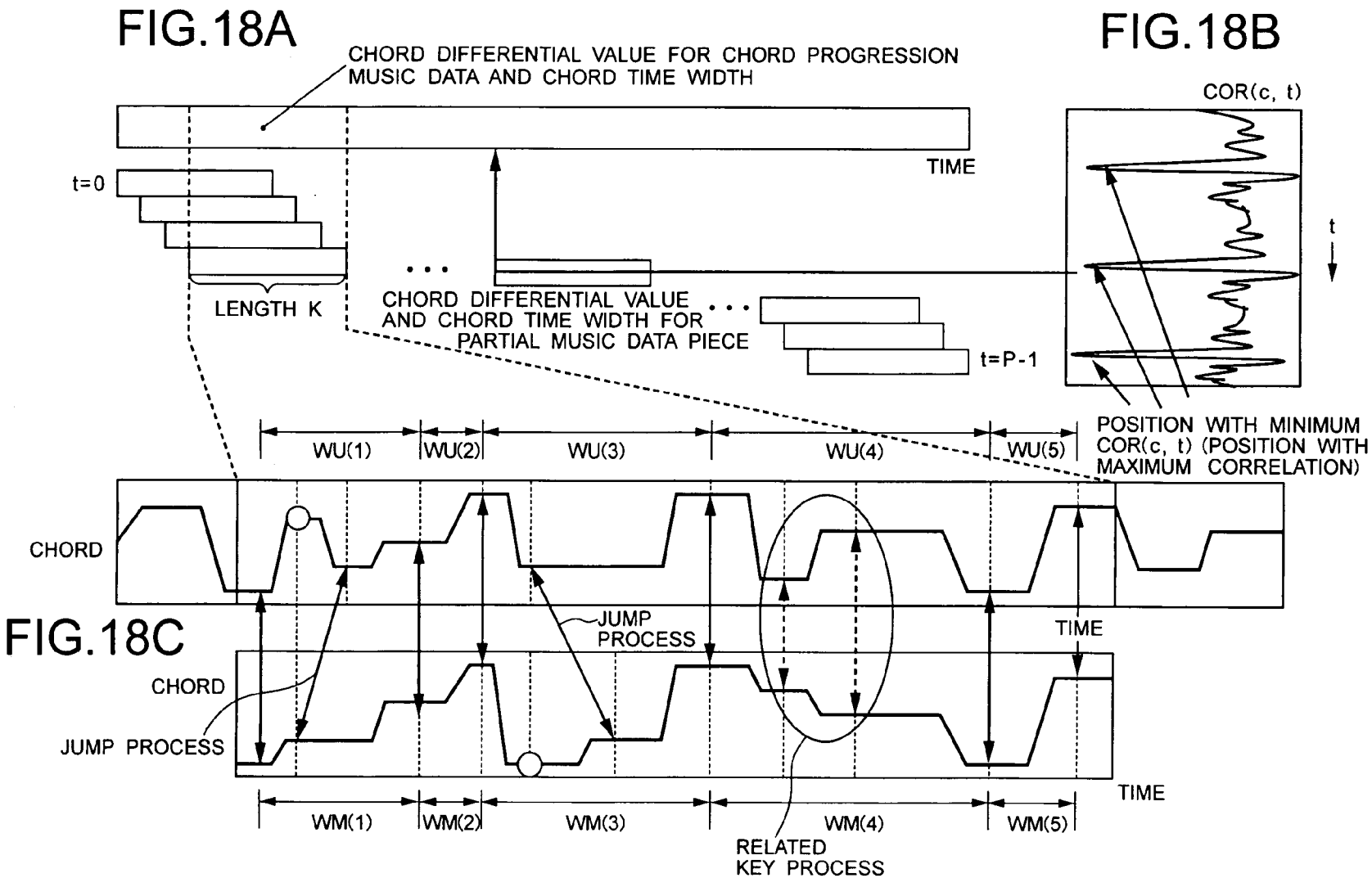
FIGS. 18A to 18C show the relation between the C-th chord progression music data and chord progression music data for a search object, changes of a correlation coefficient COR(t), time widths for which chords are maintained, jump processes, and a related key process.

FIG. 18A shows the relation between chord progression music data to be processed and its partial music data pieces. In the partial music data pieces, the part to be compared to the chord progression music data changes as t advances. FIG. 18B shows changes in the correlation coefficient COR(t) or COR'(t). The similarity is high at peaks in the waveform.

FIG. 18C shows time widths WU(1) to WU(5) during which the chords are maintained, a jump process portion and a related key portion in a cross-correlation operation between the chord progression music data to be processed and its partial music data pieces. The double arrowhead lines between the chord progression music data and partial music data pieces point at the same chords. The chords connected by the inclined arrow lines among them and not present in the same time period represent chords detected by the jump process. The double arrowhead broken lines point at chords of related keys.

The cross-correlation coefficients COR(t) and COR'(t) calculated in steps S59 and S60 are added to produce a total cross correlation coefficient COR(c, t) (step S61). More specifically, COR(c, t) is calculated by the following expression (5):

$$COR(c,t)=COR(t)+COR'(t) \text{ where } t=0 \text{ to } P-1 \quad (5)$$

Figure 19A:
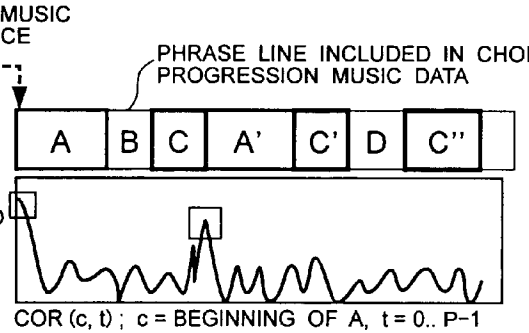
FIGS. 19A to 19F show changes of the correlation coefficient COR(c, t) corresponding to a phrase included in partial music data and a line of phrases included in chord progression music data.
Figure 19B:
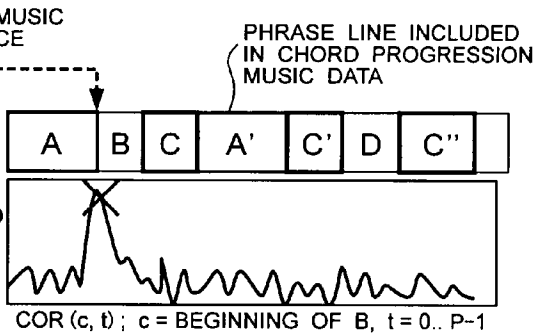
Figure 19C:
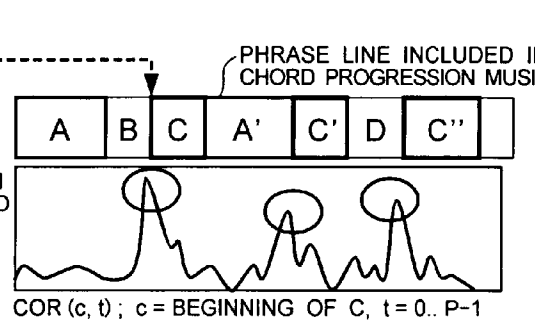
Figure 19D:
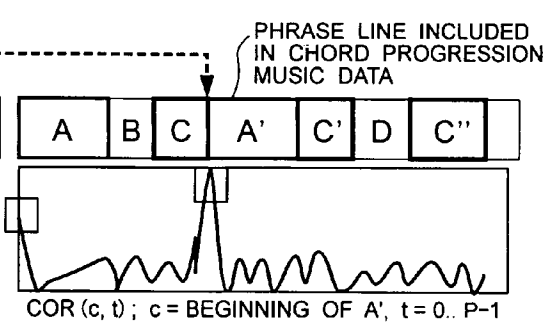
Figure 19E:
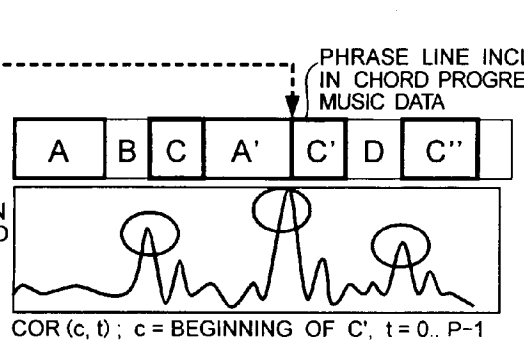
Figure 19F:
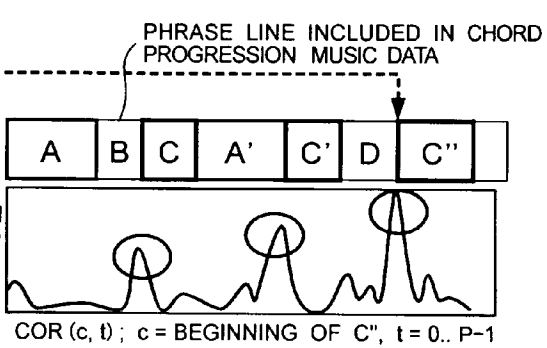

FIGS. 19A to 19F each show the relation between phrases (chord progression row) in a music piece represented by chord progression music data to be processed, a phrase represented by a partial music data piece, and the total correlation coefficient COR(c, t). The phrases in the music piece represented by the chord progression music data are arranged like A, B, C, A', C', D, and C" in the order of the flow of how the music goes after introduction I that is not shown. The phrases A and A' are the same and the phrases C, C', and C" are the same. In FIG. 19A, phrase A is positioned at the beginning of the partial music data piece, and COR(c, t) generates peak values indicated with □ in the points corresponding to phrases A and A' in the chord progression music data. In FIG. 19B, phrase B is positioned at the beginning of the partial music data piece, and COR(c, t) generates a peak value indicated with X in the point corresponding to phrase B in the chord progression music data. In FIG. 19C, phrase C is positioned at the beginning of the partial music data piece, and COR(c, t) generates peak values indicated with ○ in the points corresponding to phrases C, C', and C" in the chord progression music data. In FIG. 19D, phrase A' is positioned at the beginning of the partial music data piece, and COR(c, t) generates peak values indicated with □ in points corresponding to phrases A and A' in the chord progression music data. In FIG. 19E, phrase C' is positioned at the beginning of the partial music data piece, and COR(c, t) generates peak values indicated with ○ in the points corresponding to phrases C, C' and C" in the chord progression music data. In FIG. 19F, phrase C" is positioned at the beginning of the partial music data piece, and COR(c, t) generates peak values indicated with ○ in the points corresponding to phrases C, C', and C" in the chord progression music data.

After step S61, the counter value c is incremented by one (step S62), and it is determined whether or not the counter value c is greater than P−1 (step S63). If c≦P−1, the correlation coefficient COR(c, t) has not been calculated for the entire chord progression music data to be processed. Therefore, the control returns to step S56 and the operation in steps S56 to S63 described above is repeated.

If c>P−1, COR(c, t), i.e., the peak values for COR(0, 0) to COR(P−1, P−1) are detected, and COR_PEAK(c, t)=1 is set for c and t when the peak value is detected, while COR_PEAK(c, t)=0 is set for c and t when the value is not a peak value (step S64). The highest value in the part above a predetermined value for COR(c, t) is the peak value. By the operation in step S64, the row of COR_PEAK(c, t) is formed. Then in the COR_PEAK(c, t) row, the total value of values for COR_PEAK(c, t) as t changes from 0 to P−1 is calculated as the peak number PK(t) (step S65). PK(0)=COR_PEAK(0, 0)+COR_PEAK(1, 0)+ . . . COR_PEAK(P−1, 0), PK(1)=COR_PEAK(0, 1)+COR_PEAK(1, 1)+ . . . COR_PEAK(P−1, 1), . . . , PK(P−1)=COR_PEAK(0, P−1)+COR_PEAK(1, P−1)+ . . . COR_PEAK (P−1, P−1). Among peak numbers PK(0) to PK(P−1), at least two consecutive identical number ranges are separated as identical phrase ranges, and music structure data is stored in the data storing device 5 accordingly (step S66). If for example the peak number PK(t) is two, it means the phrase is repeated twice in the music piece, and if the peak number PK(t) is three, the phrase is repeated three times in the music piece. The peak numbers PK(t) within an identical phrase range are the same. If the peak number PK(t) is one, the phrase is not repeated.

Figure 20:
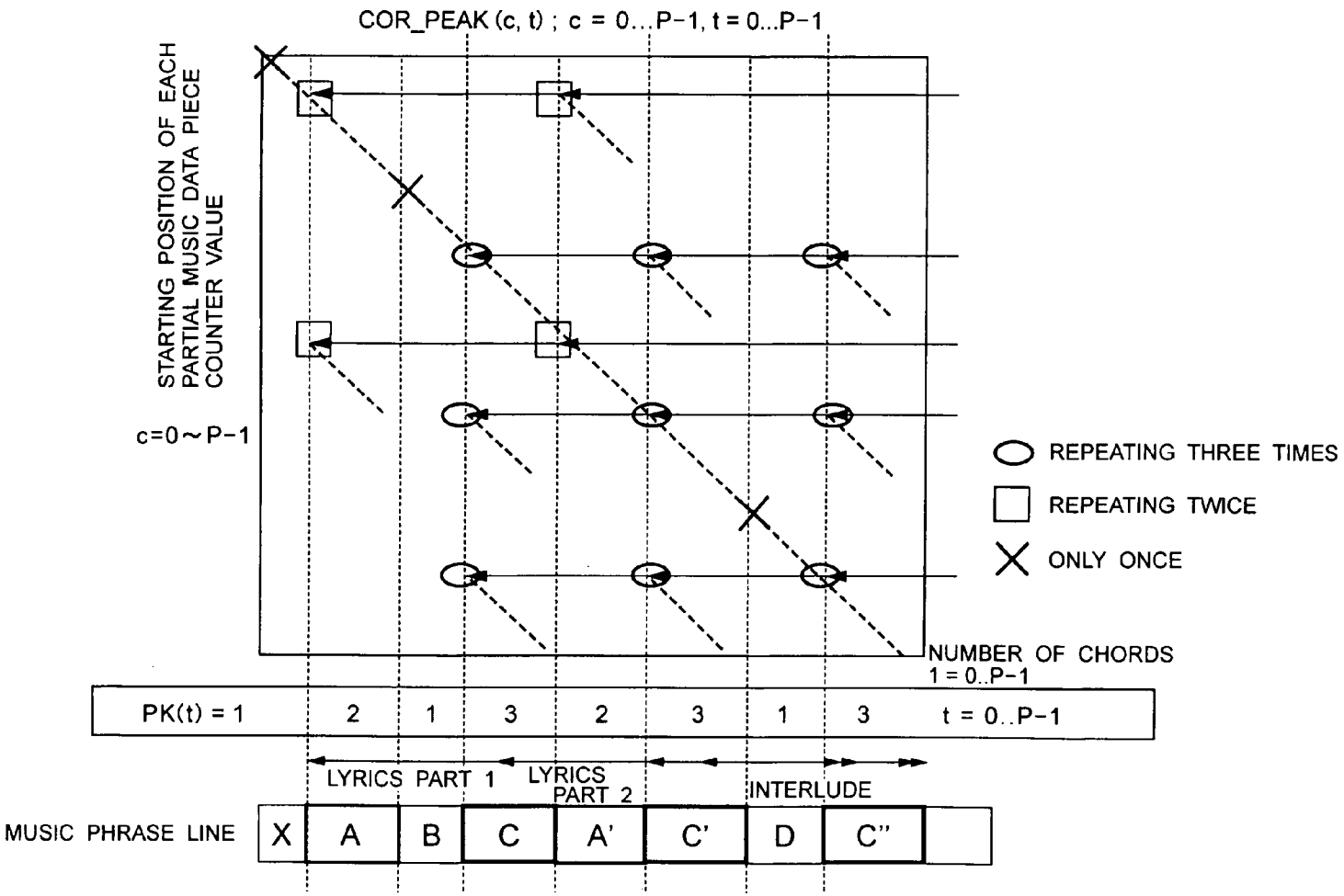
FIG. 20 shows peak numbers PK(t) for a music piece having the phrase line in FIGS. 19A to 19F and a position COR_PEAK(c, t) where a peak value is obtained.

FIG. 20 shows peak numbers PK(t) for a music piece having phrases I, A, B, C, A', C', D, and C" shown in FIGS. 19A to 19F and positions COR_PEAK (c, t) where peak values are obtained on the basis of the calculation result of the cross correlated coefficient COR(c, t). COR_PEAK(c, t) is represented in a matrix, the abscissa represents the number of chords t=0 to P−1, and the ordinate represents the starting positions c=0 to P−1 for partial music data pieces. The dotted part represents the position corresponding to COR_PEAK(c, t)=1 where COR(c, t) attains a peak value. A diagonal line represents self correlation between the same data, and therefore shown with a line of dots. A dot line in the part other than the diagonal lines corresponds to phrases according to repeated chord progression. With reference to FIGS. 19A to 19F, X corresponds to phrases I, B, and D that are performed only once, ○ represents three-time repeating phrases C, C', and C", and □ corresponds to twice-repeating phrases A and A'. The peak number PK(t) is 1, 2, 1, 3, 2, 3, 1, and 3 for phrases I, A, B, C, A', C', D, and C", respectively. This represents the music piece structure as a result.

The music structure data has a format as shown in FIG. 21. Chord progression music data T(t) shown in FIG. 14C is used for the starting time and ending time information for each phrase.

Figure 22:
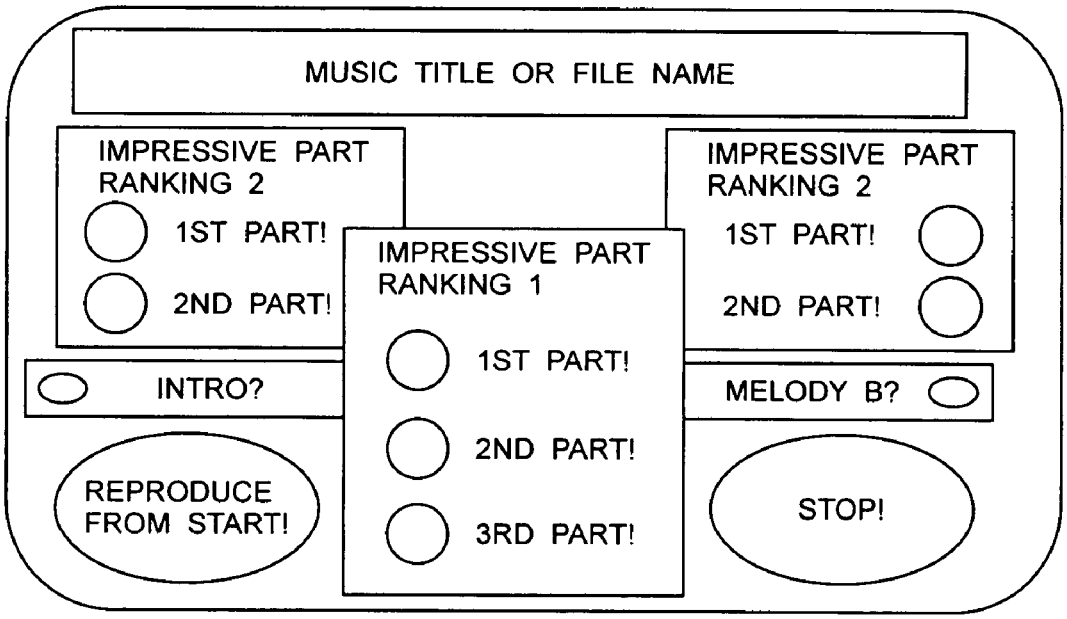
FIG. 22 shows an example of display at a display device.

The music structure detection result is displayed at the display device 9 (step 67). The music structure detection result is displayed as shown in FIG. 22, so that each repeating phrase part in the music piece can be selected. Music data for the repeating phrase part selected using the display screen or the most frequently repeating phrase part is read out from the music data storing device 4 and supplied to the music reproducing device 10 (step S68). In this way, the music reproducing device 10 sequentially reproduces the supplied music data, and the reproduced data is supplied to the digital-analog converter 11 as a digital signal. The signal is converted into an analog audio signal by the digital-analog converter 11 and then reproduced sound of the repeating phrase part is output from the speaker 12.

Consequently, the user can be informed of the structure of the music piece from the display screen and can easily listen to a selected repeating phrase or the most frequently repeating phrase in the music piece of the process object.

Step S56 in the above music structure detection operation corresponds to the partial music data producing device (FOR EP: partial music data producing means). Steps S57 to S63 correspond to the comparison means for calculating similarities (cross correlation coefficient COR(c, t)), step S64 corresponds to the chord position detector (FOR EP: chord position detection means), and steps S65 to S68 correspond to the output device (FOR EP: output means).

The jump process and related key process described above are carried out to eliminate the effect of extraneous noises or the frequency characteristic of an input device when chord progression music data to be processed is produced on the basis of an analog signal during the operation of the differential value before and after the chord transition. When rhythms and melodies are different between the first and second parts of the lyrics or there is a modulated part even for the same phrase, data pieces do not completely match in the position of chords and their attributes. Therefore, the jump process and related key process are also carried out to remedy the situation. More specifically, if the chord progression is temporarily different, similarities can be detected in the tendency of chord progression within a predetermined time width, and therefore it can accurately be determined whether the music data belongs to the same phrase even when the data pieces have different rhythms or melodies or have been modulated. Furthermore, by the jump process and related key process, accurate similarities can be obtained in cross-correlation operations for the part other than the part subjected to these processes.

Note that in the above embodiment, the invention is applied to music data in the PCM data form, but when a row of notes included in a music piece are known in the processing in step S28, MIDI data may be used as the music data. Furthermore, the system according to the embodiment described above is applicable in order to sequentially reproduce only the phrase parts repeating many times in the music piece. In other words, a highlight reproducing system for example can readily be implemented.

Figure 23:
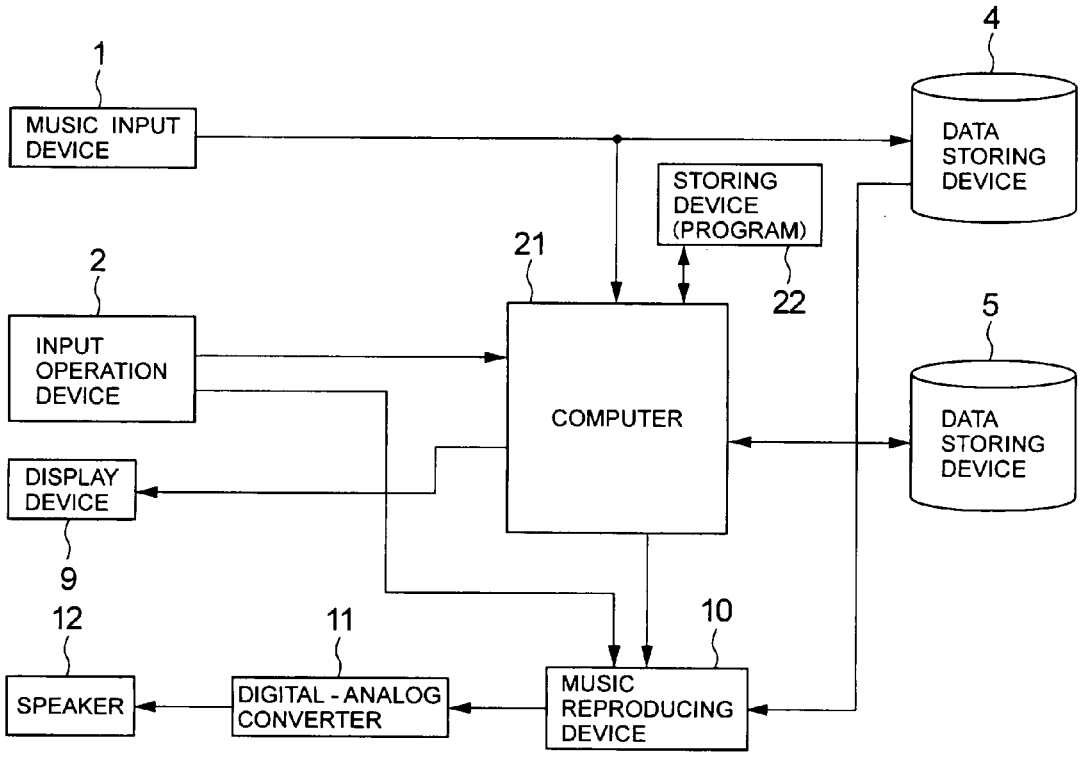
FIG. 23 is a block diagram of the configuration of a music processing system as another embodiment of the invention.

FIG. 23 shows another embodiment of the invention. In the music processing system in FIG. 23, the chord analysis device 3, the temporary memory 6, the chord progression comparison device 7 and the repeating structure detection device 8 in the system in FIG. 1 are formed by the computer 21. The computer 21 carries out the above chord analysis operation and the music structure detection operation in response to a program stored in the storing device 22. The storing device 22 does not have to be a hard disk drive and may be a drive for a storage medium. In the case, chord progression music data may be written in the storage medium.

As in the foregoing, according to the invention, the structure of a music piece including repeating parts can appropriately be detected with a simple structure.

This application is based on a Japanese Patent Application No. 2002-352865 which is hereby incorporated by reference.

What is claimed is:

1. A music structure detection apparatus detecting a structure of a music piece in accordance with chord progression music data representing chronological changes in chords in the music piece, comprising:

a partial music data producing device which produces partial music data pieces each including a predetermined number of consecutive chord transitions starting from a position of each chord transition in said chord progression music data;

a comparator which compares each of said partial music data pieces with said chord progression music data from each of the starting chord positions in said chord progression music data, on the basis of an amount of change in a root of a chord in each chord transition and an attribute indicating a type of chord after the chord transition, thereby calculating degrees of similarity for each of said partial music data pieces;

a chord position detector which detects a position of a chord transition in said chord progression music data where at least one indicating higher similarity of the similarity degrees calculated for each of said partial music data pieces is obtained; and an output device which calculates a number of times that the calculated similarity degree indicates the higher similarity for all said partial music data pieces for each chord transition position in said chord progression music data, thereby producing a detection output representing the structure of the music piece in accordance with the calculated number of times for each chord transition position.

2. The music structure detection apparatus according to claim 1, wherein said comparator compares each of said partial music data pieces with said chord progression music data in the basis of the amount of change in the root of a chord in each chord transition position in said chord progression music data, the attribute of the chord after the transition and a ratio of time lengths for which the chord before and a chord after the transition are maintained, so as to calculate the similarity degrees for each of said partial music data pieces.

3. The music structure detection apparatus according to claim 1, further comprising a data making portion which makes first and second chord candidates indicating in chronological order a chord for each chord transition of the music piece in accordance with an input audio signal representing the music piece, each of said partial music data pieces and said chord progression music data each having the first and second chord candidates, and said comparator compares the first and second chord candidates of each of said partial music data pieces and the first and second chord candidates of said chord progression music data.

4. The music structure detection apparatus according to claim 3, wherein said data making portion includes:

a frequency converter which samples an input audio signal representing a music piece at predetermined time intervals, and converts the sampled audio signal into a frequency signal representing a level for each frequency component;

a component extractor which extracts a frequency component corresponding to each tempered tone from the frequency signal obtained by said frequency converter at said predetermined time intervals;

a chord candidate detector which detects two chords each formed by a set of three frequency components as said first and second chord candidates, said three frequency components being higher in level than the other frequency components of the extracted frequency components; and a smoothing device which cancels a candidate indicating a noise component in trains of said first and second chord candidates repeatedly detected by said chord candidate detector, so that a same chord is successively arranged in at least two chord candidates including the canceled portion, to produce said chord progression music data.

5. The music structure detection apparatus according to claim 1, wherein said comparator adds temporary data having a number of temporary chord transitions equal to the predetermined number of consecutive chord transitions, to the end of said chord progression music data so that all the chord transition positions of said chord progression music data can have a number of chord transitions equal to the predetermined number of consecutive chord transitions in an ending direction of the said chord progression music data.

6. The music structure detection apparatus according to claim 1, wherein said output device detects a maximum of the calculated numbers of times for the respective chord transition positions in said chord progression music data, and outputs sound of the music piece from a position in the music piece corresponding to a chord transition position where the maximum is obtained.

7. The music structure detection apparatus according to claim 1, wherein said comparator makes a first chord differential value train indicating in chronological order the change amount in a root chord for each chord transition and a first attribute train indicating in chronological order the attribute for each chord transition, in accordance with the chord progression music data, makes a second chord differential value train indicating in chronological order the change amount in a root chord for reach chord transition and a second attribute train indicating in chronological order the attribute for each chord transition, in accordance with one of the partial music data pieces, compares the second chord differential value train with the first chord differential value train, and compares the second attribute train with the first attribute train, in order to calculate the similarity degrees for the one partial music data piece.

8. The music structure detection apparatus according to claim 7, wherein when a chord after one chord transition in the one partial music data piece, and a chord after one chord transition in said chord progression music data are related with each other based on the relative key expression in the music theory by comparing the second chord differential value train with the first chord differential value train, and by comparing the second attribute train with the first attribute train, the comparator regards both the chords after the one transitions as the same chord.

9. The music structure detection apparatus according to claim 7, wherein said comparator compares an n-th (wherein n is an integer larger than zero) chord differential value and chord differential values arranged before and after the n-th chord differential value of the second chord differential value train with an n-th chord differential value of the first chord differential value train, and compares an n-th attribute and attributes arranged before and after the n-th attribute of the second attribute train with an n-th attribute of the first attribute train, threreby detecting higher similarity.

10. A method of detecting a structure of a music piece in accordance with chord progression music data representing chronological changes in chords in the music piece, said method comprising the steps of:

producing partial music data pieces each including a predetermined number of consecutive chord transitions starting from a position of each chord transition in said chord progression music data;

comparing each of said partial music data pieces with said chord progression music data from each of the starting chord positions in said chord progression music data, on the basis of an amount of change in a root of a chord in each chord transition and an attribute indicating a type of chord after the transition, thereby calculating degrees of similarity for each of said partial music data pieces;

detecting a position of a chord transition in said chord progression music data where at least one indicating higher similarity of the similarity degrees calculated for each of said partial music data pieces is obtained; and calculating a number of times that the calculated similarity degree indicates the higher similarity for all said partial music data pieces for each chord transition position in said chord progression music data, thereby producing a detection output representing the structure of the music piece in accordance with the calculated number of times for each chord transition position.

11. A computer program embedded on a computer-readable medium comprising a program for detecting a structure of a music piece, said detecting comprising the steps of:

producing partial music data pieces each including a predetermined number of consecutive chord transitions starting from a position of each chord transition in said chord progression music data;

comparing each of said partial music data pieces with and said chord progression music data from each of the starting chord positions in said chord progression music data, on the basis of an amount of change in a root of a chord in each chord transition and an attribute indicating a type of chord after the chord transition, thereby calculating degrees of similarity for each of said partial music data pieces;

detecting a position of a chord transition in said chord progression music data where at least one indicating higher similarity of the similarity degrees calculated for each of said partial music data pieces is obtained; and calculating a number of times that the calculated similarity degree indicates the higher similarity for all said partial music data pieces for each chord transition position in said chord progression music data, thereby producing a detection output representing the structure of the music piece in accordance with the calculated number of times for each chord transition position.

* * * * *